US005584085A

United States Patent [19]

Banko

[11] Patent Number: 5,584,085

[45] Date of Patent: Dec. 17, 1996

[54] SUPPORT STRUCTURE WITH MOTION

[75] Inventor: William Banko, New York, N.Y.

[73] Assignee: Surgical Design Corporation, Long Island City, N.Y.

[21] Appl. No.: 320,731

[22] Filed: Oct. 7, 1994

Related U.S. Application Data

[63] Continuation-in-part of Ser. No. 728,022, Jul. 8, 1991, abandoned, which is a continuation of Ser. No. 399,326, Aug. 24, 1989, abandoned.

[51] Int. Cl.[6] ..... A47C 27/10

[52] U.S. Cl. ..... 5/710; 5/713

[58] Field of Search ..... 5/456, 914, 933, 5/453, 455, 450

[56] References Cited

U.S. PATENT DOCUMENTS

| | | | |
|---|---|---|---|
| 1,772,310 | 8/1930 | Hart . | |
| 2,245,909 | 6/1941 | Enfiajian | 5/455 |
| 3,446,203 | 5/1969 | Murray . | |
| 3,477,071 | 11/1969 | Emerson . | |
| 3,653,083 | 4/1972 | Lapidus . | |
| 3,872,525 | 3/1975 | Lea et al. | 5/453 |
| 3,959,835 | 6/1976 | Nos | 5/455 |
| 4,149,541 | 4/1979 | Gammons et al. . | |
| 4,197,837 | 4/1980 | Tringali et al. . | |
| 4,207,633 | 6/1980 | Smith | 5/455 |
| 4,225,989 | 11/1980 | Corbett et al. . | |
| 4,267,611 | 5/1981 | Agulnick . | |
| 4,694,521 | 9/1987 | Tominaga | 5/453 |
| 4,745,647 | 5/1988 | Goodwin . | |
| 4,896,389 | 1/1990 | Chamberland . | |
| 4,907,308 | 3/1990 | Leininger et al. | 5/455 |
| 4,944,060 | 7/1990 | Peery et al. . | |
| 4,953,247 | 9/1990 | Hasty | 5/455 |
| 5,003,654 | 4/1991 | Vrzalik . | |

(List continued on next page.)

FOREIGN PATENT DOCUMENTS

| | | | |
|---|---|---|---|
| 2373996 | 8/1978 | France | 5/456 |
| 876760 | 4/1953 | Germany . | |
| 2446935 | 4/1976 | Germany . | |

OTHER PUBLICATIONS

Grant, Alternating Pressure Seat Pad, Stamford, Connecticut.
Grant Dyna–Care, Stamford, Connecticut.
Sunrise Medical Bio Clinic, Top Cat, Ontario, Canada.
Hard Pressed for Zero Pressure, Deerfield Beach, Florida.
Madeleine St. Clair, Pegasus Airwave Ltd., Descriptive Study of the Use of a Specialty Bed in the United Kingdom.
Lumex, Akrotech 400.
Flxeciair II, Low Airloss Therapy.
Sunrise Medical/Bio Clinic, Orthoderm Therapy Products, The Future of Air Thearpy Beds.
Flexicair MC3 Low Airloss Therapy, Charleston, SC.
Sunrise Medical Bio Clinic, Economic Relief.
Sunrise Medical Bio Clinic, Bio Flote Air Floatation System.
Clensicair, Incontinence Management System, Introducting Anew System That Unites Proven Low Airloss Therapy with Unique Incontinence Management Features.
Clinitron Elexis, Air Fluidize Therapy, Superior Wound Therapy in a Superior New Design.
Rescue CC, Dynamic Air Therapy.
Bio Therapy Advance Pressure Relief System.
Acucair Continuous Air Flow System From SSI . . . .

*Primary Examiner*—Michael J. Milano
*Attorney, Agent, or Firm*—Darby & Darby, P.C.

[57] ABSTRACT

A support arrangement is provided which has a simplified structure and is quite versatile in the support surface which is produced. The support structure includes a number of chambers or pillows which are coupled together in a sequential or serial relationship such that the air supplied to the support to inflate the chambers or pillows enters at one end and travels the length of the chamber or pillow to enter and inflate the next chamber or pillow. That is, the air supply follows a serpentine path. In this manner a simplified air supply arrangement is accomplished for the entire support structure.

31 Claims, 21 Drawing Sheets

U.S. PATENT DOCUMENTS 5,052,067 11/1991 Thomas et al. .
5,090,977 2/1992 Caden et al. .
5,109,561 5/1992 Schild .
5,117,518 6/1992 Schild ..... 5/914
5,216,768 6/1993 Bodine et al. .
5,235,713 8/1993 Guthrie et al. ..... 5/453
5,251,349 11/1993 Thomas et al. .
5,267,364 12/1993 Volk .
5,323,500 6/1994 Roe et al. ..... 5/453
5,388,292 2/1995 Stinson et al. ..... 5/453

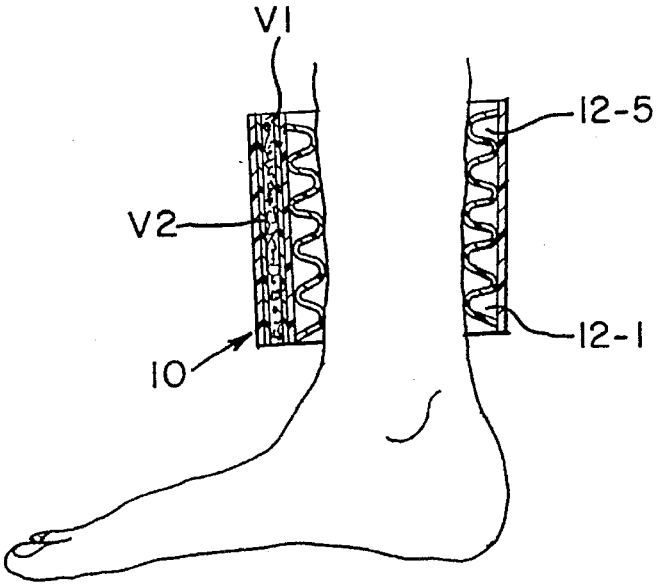
FIG. 4
FIG. 6
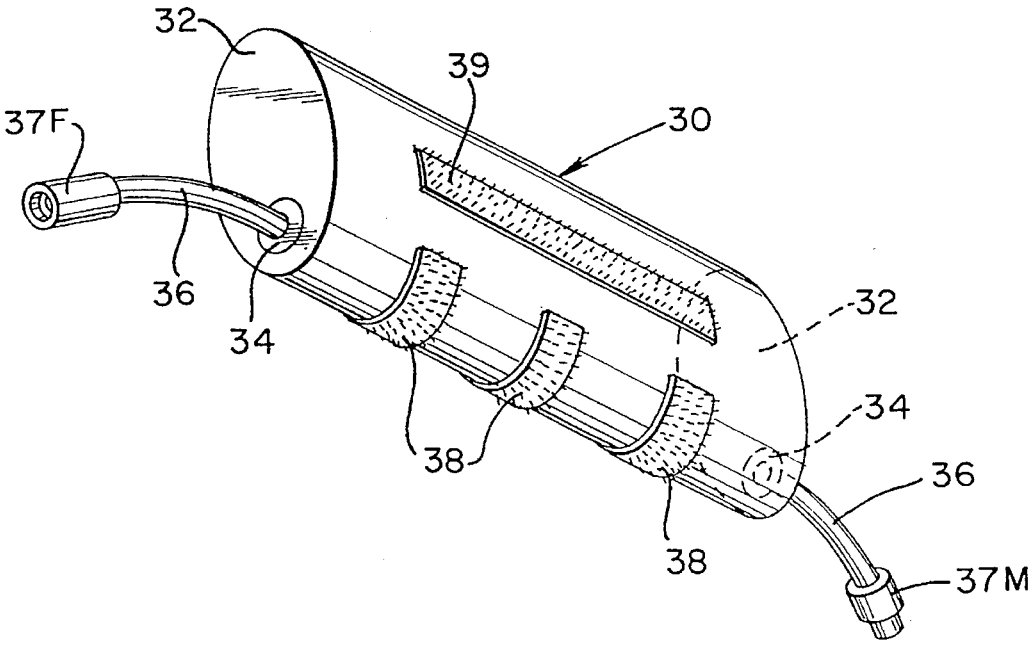

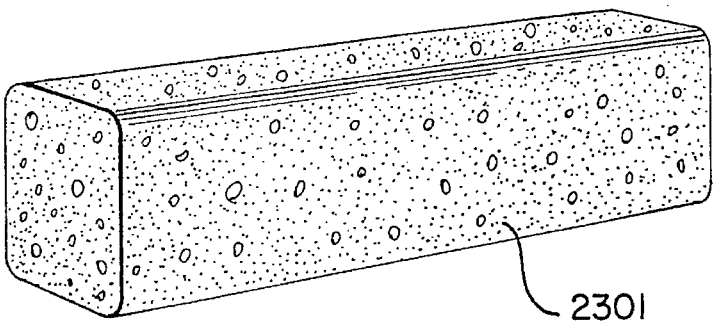
FIG. 23
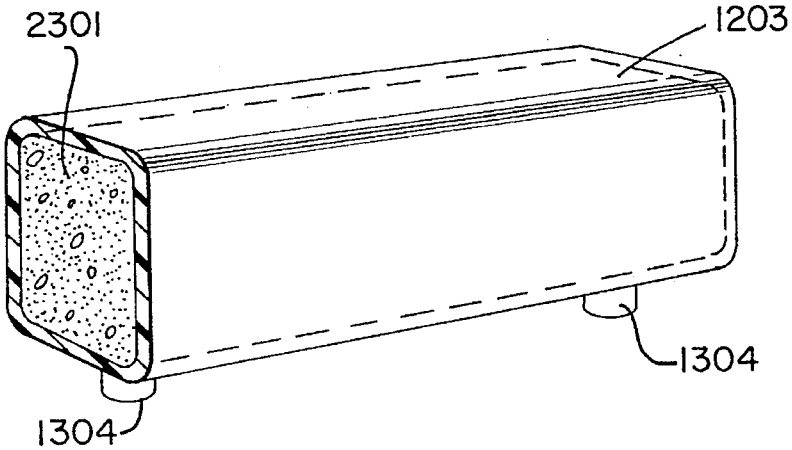
FIG. 24
FIG. 25
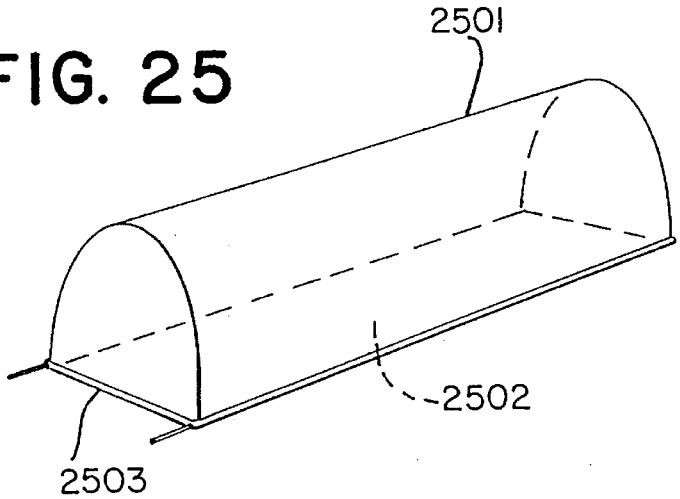
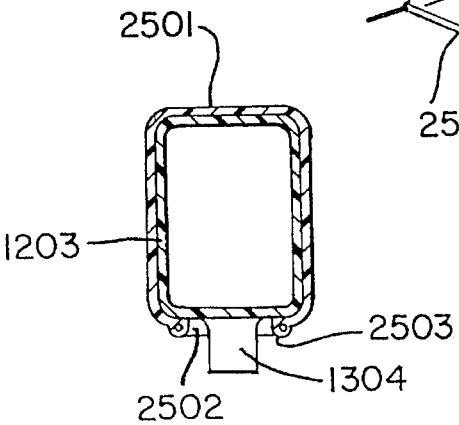
FIG. 26

SUPPORT STRUCTURE WITH MOTION

CROSS-REFERENCE TO RELATED APPLICATIONS

This is a continuation-in-part of U.S. Pat. application Ser. No. 07/728,022 filed Jul. 8, 1991, now abandoned, which is a continuation of U.S. Pat. application Ser. No. 07/399,326 filed Aug. 24, 1989, now abandoned.

FIELD OF THE INVENTION

The present invention relates to a support of inflatable pillows or chambers upon which a body can be rested, and, more particularly, to a support which includes a plurality of separate selectively inflatable interconnected pillows or chambers.

BACKGROUND OF THE INVENTION

Various types of supports are in existence on which a body can be rested. One type of support includes a plurality of inflatable pillows or chambers. These are arranged adjacent one another so that the weight of the body to be supported can rest across the surface that the pillows or chambers define. Such an arrangement has advantages in the sick room or hospital environment since the weight of a patient lying on the support is distributed across the various pillows. The pillows conform to the contour of the body thus supporting the body at more points than a conventional mattress. This means that each contact point will support less weight, thus there will be less pressure on the patient at each of these points. This has the advantage of reducing the occurrence of "bed sores" or skin ulcers. Air support mattresses of this general type are known in the art.

U.S. Pat. No. 3,446,203 to Murray discloses an air support mattress comprised of a plurality of inflatable chambers interconnected such that the chambers are inflated in a serpentine fashion in a single direction. The Murray mattress does not include a means to inflate only selected chambers. Further, individual chambers cannot be replaced in the mattress disclosed in the Murray reference since they are share walls with adjacent chambers. That is, Murray does not disclose a mattress comprised of separate, replaceable pillows.

Many available air support mattresses such as the Murray mattress are limited in the nature of the support environment in that they are static, i.e., once the chambers or pillows are inflated, they remain inflated at the same pressure and at the same height. A pulsating type of mattress support is available in which every other pillow of the mattress are alternately.

German Patent 876760 illustrates another air support mattress having interconnected chambers. The chambers, however, also appear to suffer from the disadvantage that they are not removable and replaceable. Also, there is no indication as to the portability of such a mattress. Further, the extent to which the chambers can be selectively inflated is unclear.

SUMMARY OF THE INVENTION

In view of the deficiencies of the prior art, it is an object of the invention to provide an air support mattress wherein portions can be removed and replaced, especially without deflating the remaining portions of the mattress.

It is another object of the invention to interconnect inflatable pillows to form a support mattress in such a manner that the pillows inflate in a serpentine like fashion.

Yet another object of the invention is to provide for selective inflation of portions of an air support mattress.

Still another object of the invention is to provide an air support mattress that is usable on a standard hospital bed.

Yet another object of the invention is to provide an air support system for use, not only in the hospital environment, but also can be used by a consumer on a chair or bed to reduce the pressure on the consumer's body when sitting or lying down.

Another object of the invention is to provide an air support mattress or pad that produces a massaging effect on the user.

Another object of the invention is to provide an air support mattress that is extremely portable and easy to store when not in use.

Still another object of the invention is to provide an air support mattress that is quickly and easily installed.

A novel support arrangement is provided which has a simplified structure and is quite versatile in the support surface which is produced. The support structure includes a number of chambers or pillows which are coupled together in a sequential or serial relationship such that the air supplied to the support to inflate the chambers or pillows enters at one end and travels the length of the chamber or pillow to enter and inflate the next chamber or pillow. That is, the air supply follows a serpentine path. In this manner a simplified air supply arrangement is accomplished for the entire support structure.

In a preferred embodiment, individual pillows are coupled together in an alternating sequential fashion such that the even numbered pillows are connected together and the odd numbered pillows are separately connected together. Preferably, the support includes three separate sections of the so-connected pillows, i.e., the head, the central, and the foot of the support. The individual pillows are connected in such as manner as to provide for airflow in a serpentine path.

Each pillow is preferably removably mounted on a semi-rigid support member having embedded longitudinal tubes, with each support member hingedly connected to adjacent support members. The mounting means comprises a valve-like connector that allows air to flow through the pillow. When the pillow is removed, however, air flow is redirected through the tubes embedded in the support member.

The system is also capable of producing a wave-like motion for the length of the structure. That is, the chambers or pillows are sequentially inflated under the direction of a microcontroller along the extent of the support and the body lying on the support can feel the wave-like inflation process. The air supply input volume and timing and the exhaust for the support can be adjusted to control the frequency and intensity of the wave. The wave-like motion can also be accomplished along selected parts of the complete mattress and separate parts can have the wave operating in different directions. A static support surface can be also achieved by adjusting the air inflow and exhaust. Also, a novel pillow attaching system is provided which permits one pillow to be placed at a lower position in order to be out of contact with the body while still being in the air flow sequence.

The invention can be embodied in a pad which is wrapped around a portion of the body to subject it to the wave-like motion thereby to aid venous blood circulation. The pad can be formed of two separate and superposed sheets of material sealed at various areas to form the chambers, the interconnection between the chambers formed by restricted passageways in the sealed areas.

BRIEF DESCRIPTION OF THE DRAWINGS

The foregoing and other features of the present invention will be more readily apparent from the following detailed description of preferred embodiments taken in conjunction with the attached drawings wherein:

FIG. 4 shows the inflation pad wrapped around a part of the body;

FIG. 6 is a perspective view of a pillow used as part of the support;

FIG. 23 shows a foam insert for the pillows of another preferred embodiment of the present invention;

FIG. 24 illustrates a pillow of the present invention with the foam inserted;

FIG. 25 illustrates a perspective view of a removable protective covers for the pillows of the present invention; and FIG. 26 shows a sectional end view of a pillow with the protective cover.

DETAILED DESCRIPTION OF THE INVENTION

Figure 1:
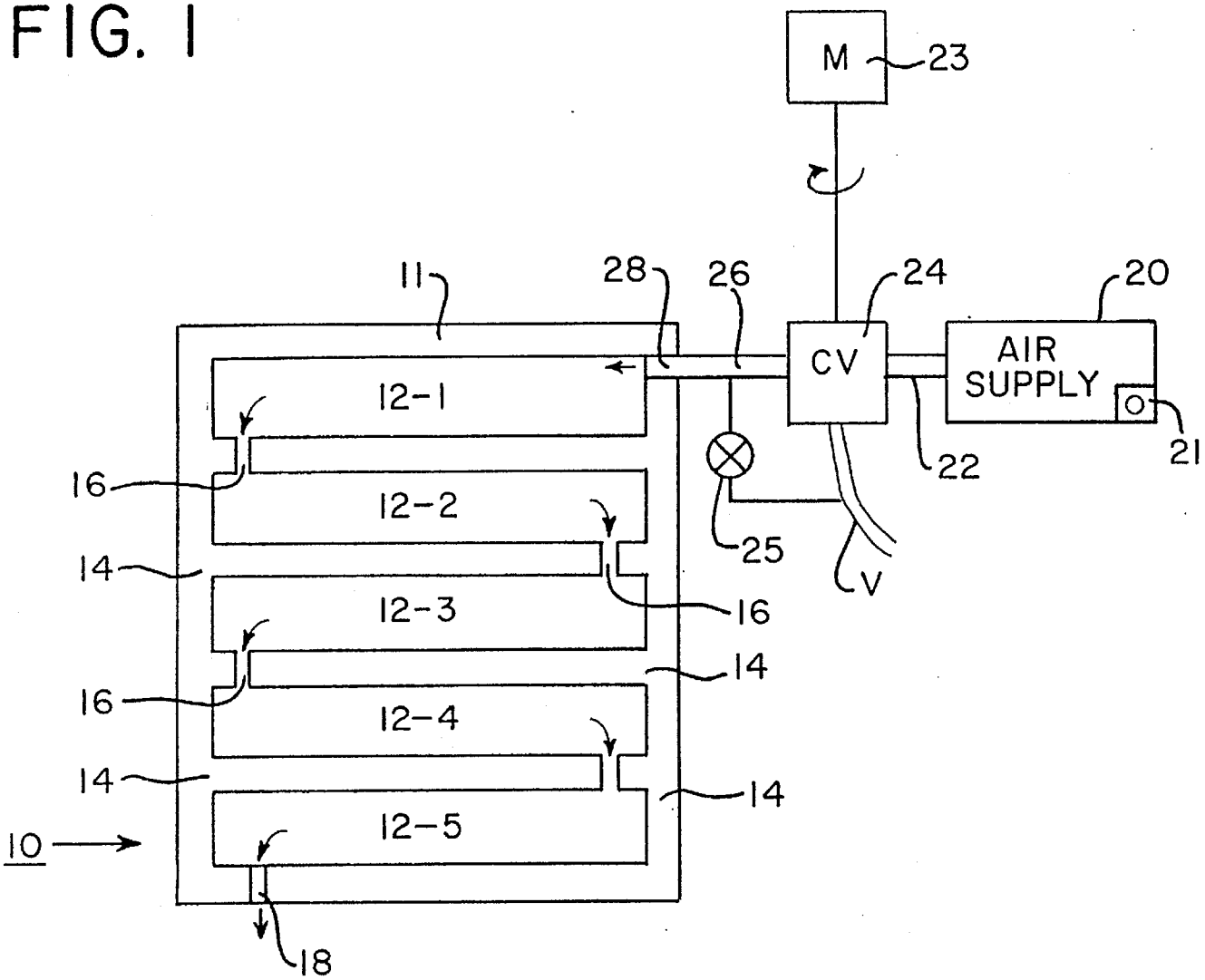
FIG. 1 is a top plan view showing a wave-type support pad made in accordance with the subject invention.

Referring to FIG. 1, the principles of the present invention are illustrated first in a support pad 10 having a plurality of inflatable chambers 12, here illustratively shown at five in number and labelled 12-1 to 12-5. The pad is made of sheets of suitable material, for example, GORE-TEX or ULTREX, which are bonded together in the appropriate manner by a suitable adhesive, ultrasonic welding, etc. The thickness and strength of the sheets of material are selected as needed and the pad can be of any suitable dimensions, either for wrapping around an extremity of the body, such as an arm or leg, or to lay on a flat surface so that a person can rest a portion of his body, such as the back, or the entirety of the body on top of the pad.

Each of the chambers 12 is separated from the next chamber by a closed area 14 to the passage of air, i.e. an area where the two sheets of material forming the pad are sealed together thereby preventing the passage of air therethrough. The bottom sheet of the pad is flat and the upper sheet configured to form the enlarged inflatable chambers 12. Two flat sheets of material are used and sealed in the areas 14 so that the two sheets form the chamber. The pad 10 has a peripheral edge area 11 which is also sealed against the passage of any air. The sealing of the various areas is accomplished by adhesive, heat sealing or any other suitable conventional technique, depending upon the type of material used.

In each closed off area 14 between two chambers 12, a passageway 16 is formed for linking the two chambers and permitting air to flow from one chamber to the next. The size of the passageway 16 is selected so that the air flow will be restricted so that the wave-like inflation motion of the chambers can be achieved as discussed below. In general, each passage 16 is restricted as compared to the size of a chamber.

The pad 10 also has a restricted outlet opening 18 to the atmosphere formed in the sealed peripheral area 11 from the last chamber, here 12-5. It can be a simple opening or passage or, if desired, an adjustable control valve can be used.

FIG. 1 shows an air supply device 20 of suitable capacity, such as a conventional air compressor or an air blower, which is operated by any suitable means, such as an electric motor driven from the normal electric supply of any suitable voltage. The supply device 20 has an air outlet 22 connected to a control valve 24 which is described in greater detail below. The control valve 24 has an outlet 26, for example a flexible outlet tube of plastic or other suitable material, which is connected to an inlet fitting 28 in the peripheral edge area 11 leading into the first chamber 12-1. The fitting 28 and a corresponding fitting at the end of outlet tube 26 are preferably of the quick disconnect type. If desired, instead of using the fitting 28, a passage can be integral as part of the pad.

Referring now to FIG. 1 in conjunction with FIG. 2, the inflation of the pad is shown in operation as to the production of a peristaltic wave, i.e., gradual sequential inflation of the chambers 12-1 through 12-5.

Figure 2A:
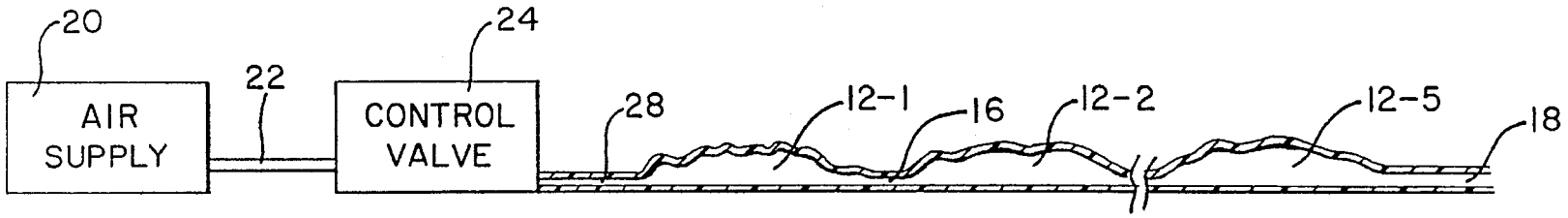
FIGS. 2A–2D is a cross-sectional view of a portion of the pad of FIG. 1 showing the pad inflation and deflation.
Figure 2B:
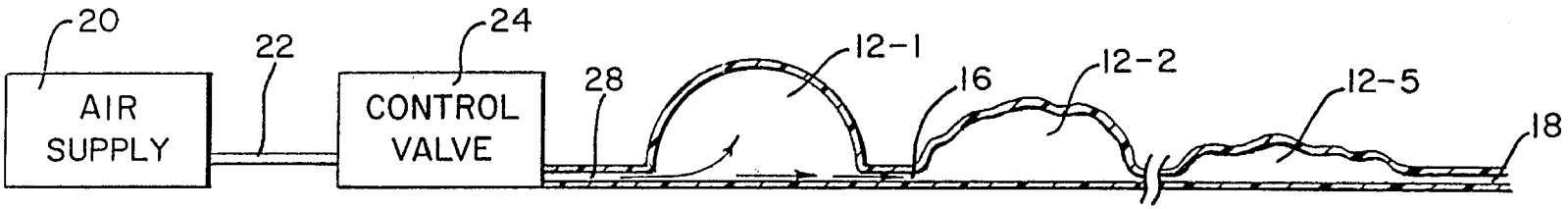

FIG. 2A shows the pad with all of the chambers 12 deflated. The air supply 20 is actuated and the supply valve 24 is in an open state. The air flows in through the passage 28 to first inflate the first chamber 12-1. There is an internal resistance in the pad in the sense that the chamber 12-1 has a restricted outlet passage 16. The size of the outlet passage 16 is such so that air will not be passed to the next successive chamber 12-2 until chamber 12-1 is substantially fully inflated. This is shown in FIG. 2B. Since the restricted outlet 16 of each chamber is at the end of the chamber remote from its inlet, the entire length of the chamber will inflate more or less at the same time on a relatively equal basis. There is some simultaneous partial inflation of the rest of the chambers, but due to the restricted outlets 16 there is generally a marked difference in the inflation of the one chamber which is principally being inflated to the next.

Figure 2C:
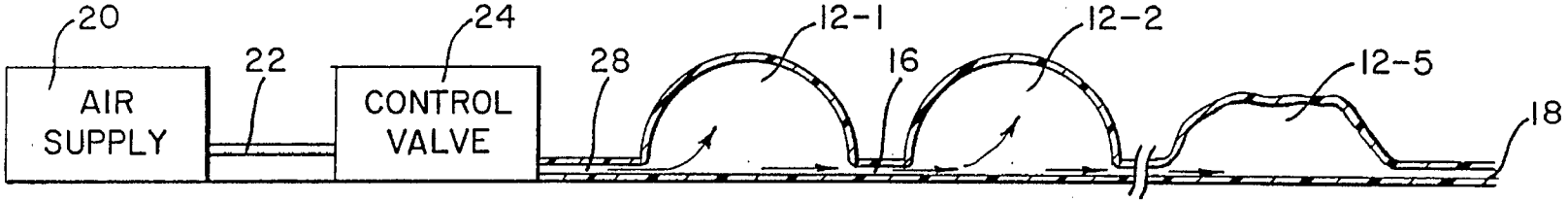
Figure 2D:
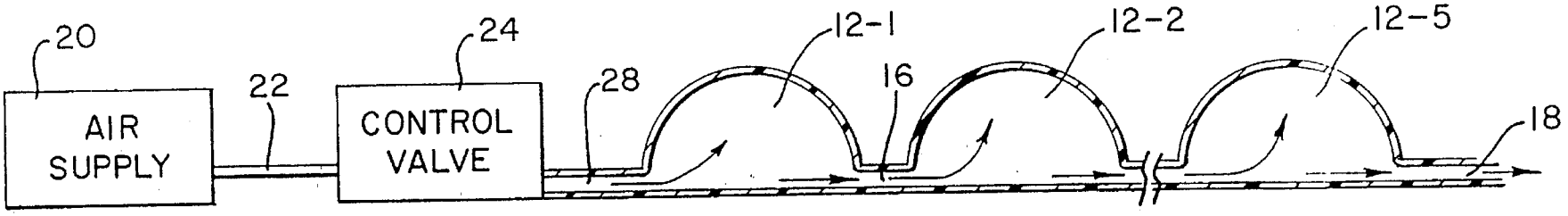

As shown in FIG. 2B, a partial inflation of the next successive chamber 12-2 starts during the time when chamber 12-1 is close to being filled to capacity. Once chamber 12-1 is filled to capacity, there is the maximum flow of the air through passage 16 from chamber 12-1 to chamber 12-2. Accordingly, chamber 12-2 becomes fully inflated, as shown in FIG. 2C. As chamber 12-2 approaches full inflation, chamber 12-3 (not shown) starts to inflate. The sequential chamber inflation continued until there is full inflation of the last chamber 12-5. This is shown in FIGS. 2C and 2D.

The process of sequential inflation of the chambers continues until all of the five chambers shown in the pad of FIG. 1 are fully inflated. It should be understood that if more than five chambers are used that the sequential inflation of all of the chambers would be carried out as described.

FIG. 1 shows by the arrows the air stream path from one chamber to the next. As can be seen, the air travels substantially the full length of a chamber 12 before exiting from that chambers passage 16 into the next successive chamber. As shown, the air flow path is essentially serpentine along the entire length of the pad.

By using the sequential inflation of each of the chambers 12 in the pad, a peristaltic type of inflation wave is produced. That is, there is a wave-like motion inflating the chambers starting from 12-1 through 12-5. As explained previously, as many chambers as necessary or desired can be used.

Air escapes through the outlet port 18. Depending upon the air volume outflow from the air supply 20 into the pad 10, the chambers can remain inflated. That is, if the volume of the outflow air from the supply 20 would be about the same, or slightly greater, than the air which is escaping through the outlet passage 18, the chambers of the pad would remain inflated.

To repeat the peristaltic wave effect, the chambers must be at least partially deflated. If the air supply is terminated, then the pad will deflate by the air escaping through outlet 18. Substantially full deflation of all chambers is achieved by stopping the air supply for a long enough period of time. This can be accomplished by operating the air supply to turn it off so that no more air is supplied to the pad. That is, the air supply can be cycled on and off by a suitable timer or controller. In a preferred embodiment of the invention, the inflation-deflation cycle is accomplished by the control valve 24.

The control valve is of the sequencer type having a rotatable gate driven by a motor 23 which alternatively opens and closes the air supply to passage 26. At the time the valve closes the supply passage, it-vents the input air from source 20 through a vent V. A preferred embodiment for the valve 24 uses solenoid type valves such as model 51C9N4 sold by VELCOR with an adjustable timer for controlling the sequencing of the solenoids.

In either approach, whether by turning off the air supply or controlling the valve 24, no more air is supplied through the input passageway 28 to the pad. Accordingly, the chambers will deflate by air leaving through the outlet passage 18. The escape of air through the passage 18 will be accelerated if pressure is applied to the chambers, for example by weight being applied to the chambers by the person lying on top of the pad or by the pad being wrapped around an extremity.

The rate of the peristaltic wave (the number of inflation-deflation cycles per minute), its speed (how fast the inflation occurs during a cycle) and its intensity (the deviation of pad height from fully inflated to fully deflated) can be regulated by the available controllable parameters. These include adjusting the input air pressure or volume produced by the air supply means 20. The greater the air flow volume or pressure, the faster the chambers will inflate and produce a wave. Control also can be affected by the resistance, i.e., the size of the communicating passages 16 between the chambers. The less resistance, the faster the next chamber will inflate. It also can be controlled by the size of the exhaust passage 18 or the exhaust holes as described below with respect to FIG. 5.

Figure 3:
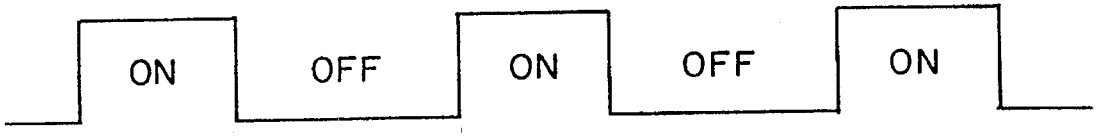
FIG. 3 is a representation of the on-off control of the air supply.

FIG. 3 diagrammatically shows the on-off cycling of the air supply to the pad. The figure shows air being supplied to the pad during the ON portion and no air being supplied during the OFF portion. The timing of the occurrence and the duration of the ON and OFF cycles can be selected by adjusting the control valve. By adjusting the ON-OFF cycle of the control valve or the ON-OFF cycle of the air supply, the rate of the peristaltic wave can be controlled, that is, how many times per minute, or per hour, that the wave-like effect will be produced.

Also, by controlling the volume of air that is being supplied by the air supply and the OFF portion of the cycle, the deflation of the pad can be controlled so that the wave intensity can be selected. The intensity is basically defined as the difference of chamber height between the maximum expansion (inflation) and maximum contraction (deflation) of each of the chambers. Control of wave intensity will make the wave more or less severe to the person lying on the pad or around whose extremity it is wrapped. If the deflation portion (air supply OFF) part of the cycle is made shorter, then the chambers 12 will not deflate as much. Consequently, on the next ON cycle when air is being supplied to the pad, the air will inflate the chambers and reach maximum inflation in a shorter time than if there was full chamber deflation since there was air left from the previous ON cycle. Also, the wave will not be as intense, i.e., the height of the pad will not increase as much as going from partial deflation to full inflation than in going from full deflation to full inflation. Accordingly, by adjusting the volume of the air input and the timing of the air supply to the pad, the frequency and intensity of the wave can be selected.

The intensity of the wave also can be controlled by controlling the volume of air from the supply. That is, if over the same duration of time for air inflation (ON) part of the cycle, the air flow from supply 20 is reduced, then the chambers will not inflate as much. The air flow volume can be controlled either directly at the supply 20 by a suitable controller which reduces or increase (adjusts) blower motor speed and/or opens and controls suitable vents in the air supply. Also, there can be a bleed line from the outlet 26 of the control valve 24 through another adjustable valve 25 to the vent V.

The speed of the wave is controlled by the air flow volume and the size of the passages between the chambers. The sequential chambers inflation is shorter in time of the air supply volume and the size of the passages 16 are increased.

Figure 1A:
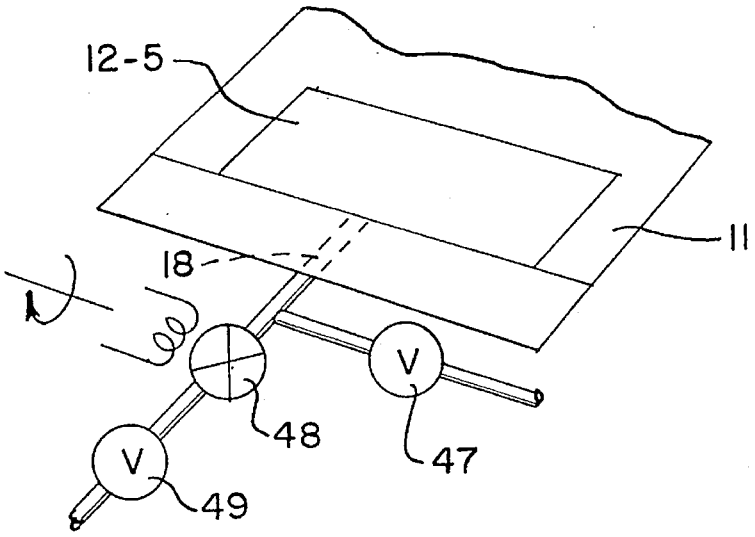
FIG. 1A is a view of a part of the pad of FIG. 2 showing an alternate relief valve arrangement.

FIG. 1A shows an alternate embodiment for the outlet section of the pad 10. Here, air outlet valve 48 has been connected to the outlet passage 18. The valve 48 is electrically operated between an open and closed position. This is achieved via a set of contacts, on a controller or timer, preferably adjustable, which is responsive to the rotation of the output shaft of motor 23 or the solenoid valve control 24. Alternatively an electronically set timer can be used. The valve 48 has a controllable outlet 49 so that the rate of air escape when the valve is opened can be controlled. If desired, it also can have to a controllable bleed vent 47 so that the rate of air outflow can be controlled for continuous air escape, like the passage 18.

Figure 1B:
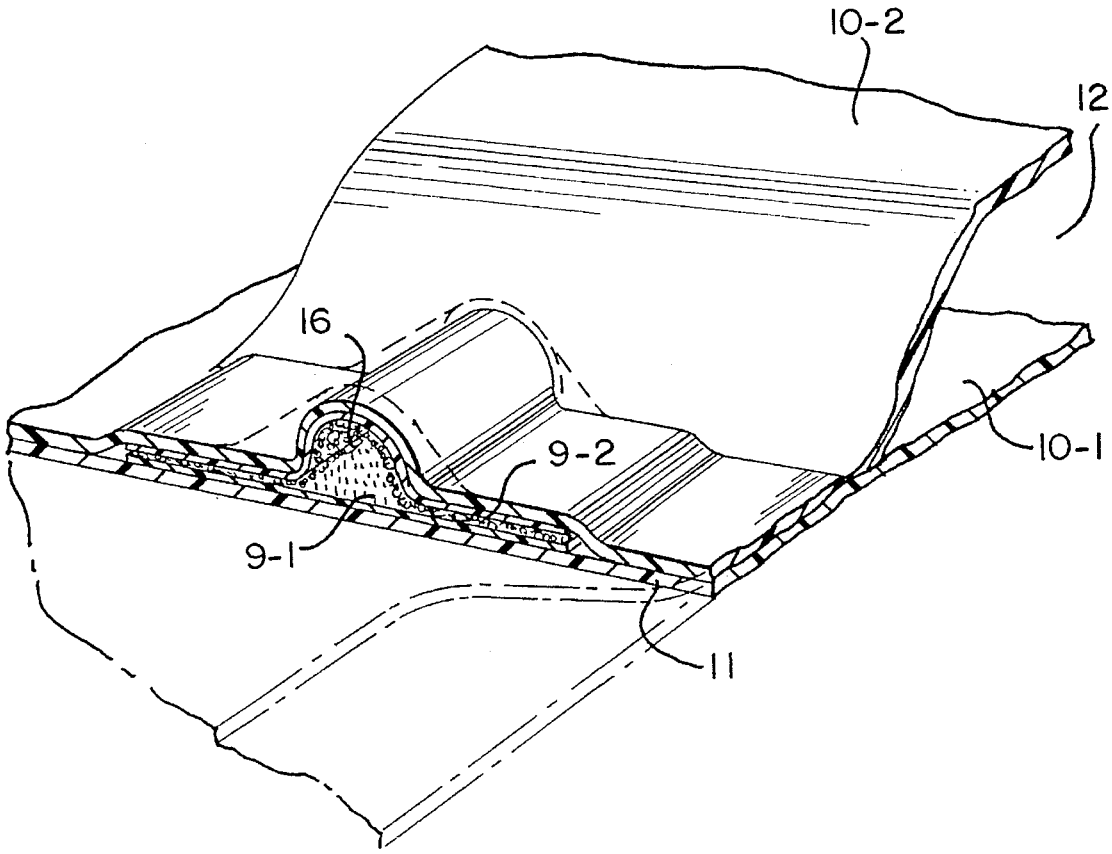
FIG. 1B is a cross-section of the pad showing an arrangement for adjusting the size of the air passage.

FIG. 1B shows an arrangement for adjustably controlling the air flow permitted by the passage 16 between the adjacent chambers 12. Here, the bottom sheet 10-1 of the pad 10 is flat and uninterrupted. On the bottom sheet 10-1, in the area 11, where the top sheet 10-2 fastened to the bottom sheet to produce the adjacent chambers, a piece 9-1 of VELCRO is fastened. A piece 9-2 of complementary VELCRO is in the area 11 on the inner surface of the top sheet 10-2.

The two pieces 9-1 and 9-2 of VELCRO are fastened together for any selected portion of their extent. That is, the larger the area of attachment between the two pieces of VELCRO, the more restricted will be the air flow passage 16. Thus, the size of the air flow passages 16 between any two chambers 12 can be adjusted. Different inflation rates for the chambers 12 can be accomplished by making the sizes of the passages 16 different.

Air flow control valves between the chambers, not shown, can be used in place of the air flow passages 16. The valves can be adjustable if it is necessary to provide a greater amount of inflation to the later inflated chambers than to the earlier ones.

The pad 10 of FIG. 1 can be laid on a flat surface and a person can rest on top of it, for example, the pad can be located in the small of his back or in the shoulder portion. The orientation of the pad can be selected in accordance with the desire of the user, i.e., the peristaltic wave can go either in the up or the down direction relative to the patient's body. For example, if the top of the pad with chamber 12-1 is located adjacent to the patient's sacrum, then the peristaltic wave will be going from the sacrum toward the thoracic vertebra. From the point of view of peripheral venous blood circulation, this may be desirable since venous blood is being pumped toward the heart.

Some situations exist in the medical environment wherein the thrombosis of a patient is intended to be avoided after surgery. A typical way of doing this is to encase the patient's arm or leg in an elastic stocking which provides pressure on the extremity on which the stocking is placed. Another approach is that used in the Jobst thrombosis device in which an inflatable pad is wrapped around the patient's arm or leg. In this device a single chamber is inflated applying a constant pressure around part of the extremity. The chamber can be inflated or deflated. In some physiotherapy applications, it is desired or beneficial to apply a massage motion to a part of the body.

FIG. 4 shows the pad of the subject invention utilized for such a therapeutic purpose. Pad 10 of FIG. 1 is shown wrapped around the leg L of a patient. The pad 10 has a piece of VELCRO V1 or other similar fastener material on the inside of the pad and complementary VELCRO V2 on the outside of the opposite side of the pad. The complementary VELCRO on the outside of the pad is made in a substantially wide strip to provide a degree of adjustability for wrapping the pad around a selected area of an extremity. Accordingly, the pad can be wrapped around the leg (or an arm) and fastened as tightly as desired. Instead of VELCRO type fasteners, bands or straps can be used.

The pad of FIG. 4 can be wrapped around any part of the body, either a leg or the arm. The direction of the wave can be selected by the location of chamber 12-1 so that the wave can progress toward or away from the heart as desired. The pad also can be wrapped with the chambers lengthwise of the extremity so that there will be a circumferential massage motion. As seen in FIG. 4, the pad is wrapped around the leg so that the first chamber 12-1 is at a lower leg position than the last chamber 12-5. Consequently, upon the sequential inflation of chambers 12-1 through 12-5, the peristaltic wave moves from the lower part of the leg upwardly toward the heart. Accordingly, the peripheral venous blood flow is pumped upwardly toward the heart.

Figure 5A:
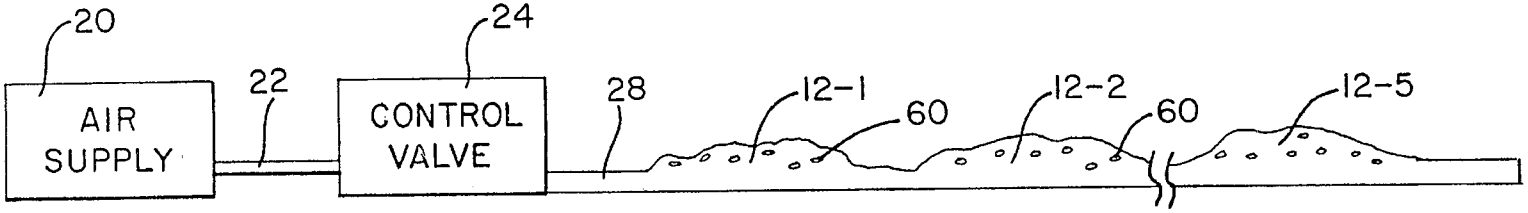
FIGS. 5A, 5B and 5C show the inflation and deflation of a pad or other support via pores.
Figure 5B:
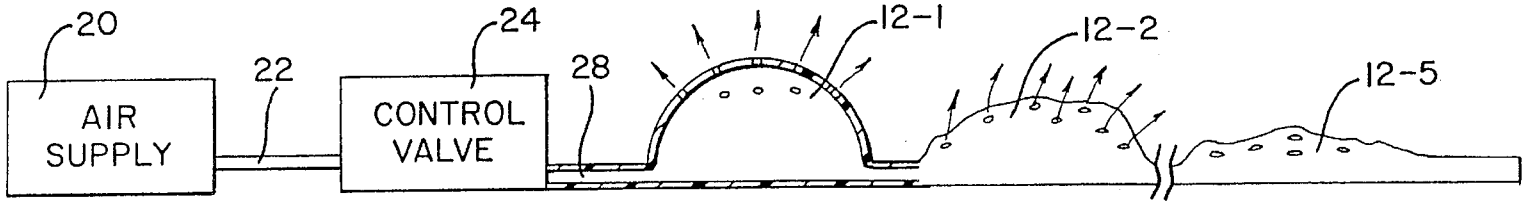
Figure 5C:
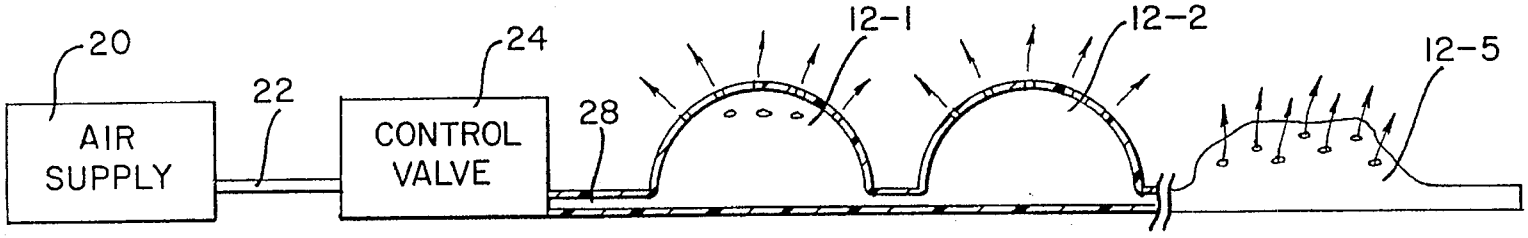

FIG. 5 shows an alternate way of obtaining the deflation of the support pad chambers. Here, instead of using an exit passage 18 or control valve 48 at the outlet of the pad, the exhaust is accomplished by pores (holes) 60 made in one of the walls of some or all of the chambers. It is preferred that the pores be located on the side of the pad which supports the user or against the part of the body about which the pad is wrapped. This provides an aeration action against the body. That is, air circulation for the skin is provided. If the air is escaping through the pores with an adequate initial force, then it can briefly provide a small localized pressure on the skin in addition to the aeration. This additional massage localized at the pores is called micromassage.

Here, as the first chamber 12-1 is inflated, there is continuous escape of some air through its holes 60, but enough pressure remains to keep the first chamber inflated and to permit air to pass through the passageway 16 from chamber 12-1 to 12-2 to inflate the second chamber 12-2. The second chamber 12-2 becomes inflated and enough pressure remains to keep the first and second chambers 12-1 and 12-2 inflated and to inflate the third and subsequent chambers, even though there is escape of air through the pores 60 in a wall of each chamber. The inflation continues for all of the chambers.

The pad of FIG. 5 can be deflated with the inflation deflation cycle control as described with respect to FIG. 3. That is, when there is no more input air to the pad, there will be deflation of the chambers as the air exits the pad through the pores 60 in the chambers. The pores of each chamber are chosen in number and dimension to prevent the chambers from deflating more than a selected allowable limit. This is another control factor which can be used with air volume input and duration of the ON and OFF parts of the inflation/deflation cycle. To aid in the deflation if the pores are not adequate, the outlet passage 18 of FIG. 1 or the control valve 48 of FIG. 1A can be used.

If desired, not all of the chambers need have exhaust pores 60. That is, one or more of the chambers can be selected to stay inflated or more inflated relative to the rest of the chambers, say for example whereon part of a person's body is to remain elevated relative to the rest of the body and/or is not to be subjected to the travelling wave. Also, the size and number of the pores can vary from chamber to chamber. If a peristaltic wave is desired in the deflation cycle then there can be larger holes or more holes in the sequence of adjacent chambers so that the air escape is not uniform as it would be if the holes (pores) in all of the chambers would be the same.

FIG. 6 shows an arrangement for producing a peristaltic travelling wave using a number of individual inflatable chambers or pillows 30. While the construction of a pillow 30 is different from a chamber 12, the theory of operation of a support formed from a plurality of such pillows is the same as that described for the pad 10.

The pillow 30 of FIG. 6 is shown having a generally elliptical shape when it is fully inflated. Other shapes can be used, e.g., cylindrical, rectangular, triangular, etc. The curved narrow upper part of the pillow 30 is to be used for support of the body. Each pillow 30 has wall 32 at each end which has a seal 34 attached thereto in a leak proof manner. An air supply tube 36 is fastened to the pillow seal 34 by appropriate sealing which can be a combination of heat sealing and sewing. A quick disconnect fitting 37 is on the end of each tube 36. One tube 36 has a female fitting 37F and the other a male fitting 37M. The tubes 36 attached to each of two pillows are connected together by the quick disconnect fitting.

In an alternate arrangement, the fittings are on the seal 34 at each end of the pillow and a tube is used having a fitting at each end is used to connect two pillows together.

As is also seen in FIG. 6, one or more VELCRO strips 38 are attached to the bottom of the pillow 30 for a part of its height. The purpose of the strips 38 is described below.

Figure 7:
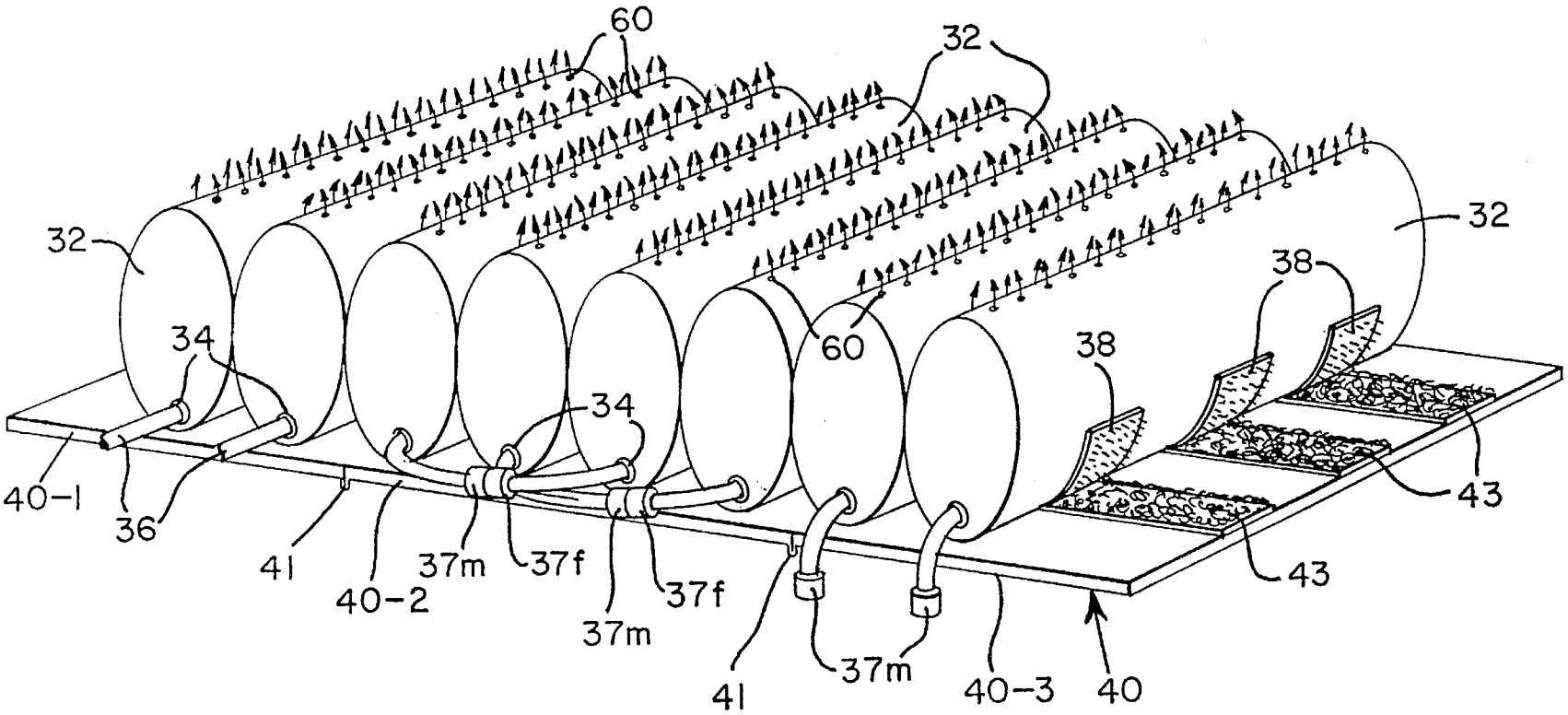
FIG. 7 is a perspective view of a part of a mattress made from a plurality of pillows of the type shown in FIG. 6.

FIG. 7 shows a number of the pillows 30 which are mounted on a flat support platform 40 to form a mattress to occupy the size of a bed. Platform 40 can made in sections 40-1, 40-2, 40-3, which are foldable using hinges 41 of any suitable type. The hinges can be detachable. For example, there can be strips of VELCRO used to connect two platform sections together.

The support platform 40 and its sections can be of any suitable material and can be either rigid, semi-rigid or flexible. In some cases, the platform sections 40 may have to conform to a surface which is not entirely flat. The support platform 40 is preferably of a flexible material such as LEXAN. Flexible or semi-rigid sheets of plastic, rubber, fiberglass or other suitable material also can be used. The support platform can be made of a combination of materials. The preferred form of platform, whether as a simple piece or in sections, is rigid enough to hold the fully inflated pillows and the person lying on them but flexible enough to conform to the positions of a mechanical bed. In a preferred embodiment, the support is made of several materials forming a sandwich including a semi-rigid plastic such as LEXAN and foam.

In FIG. 7, each of the platform sections 40 has a plurality of VELCRO strips 43 placed lengthwise of the platform 40 of a type complementary to the strips 38 on the pillows. Accordingly, a pillow 30 can be placed on one of the platform sections 40 and held in a relatively stationary position by the fastening arrangement of the mating VELCRO strips 38 and 43.

Figure 7A:
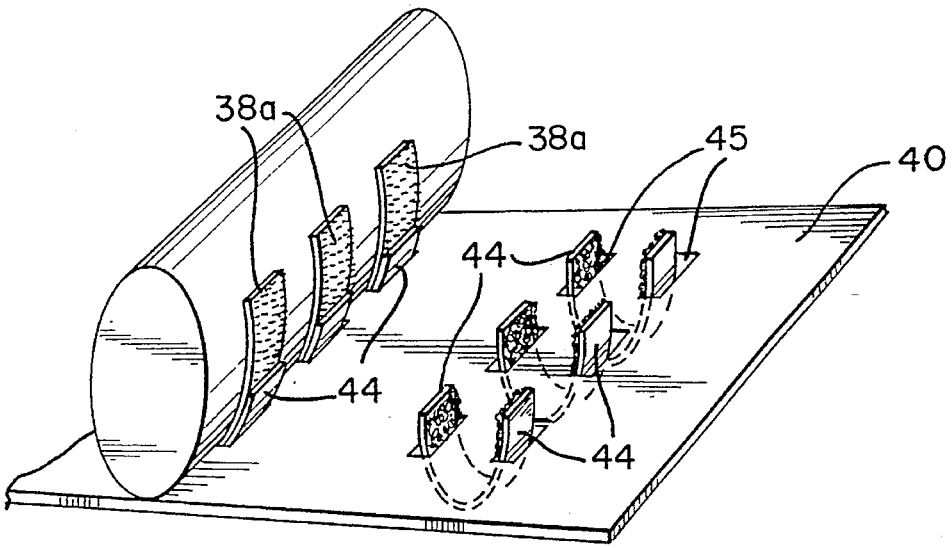
FIG. 7A is a perspective view showing the attachment of a pillow to the platform support.

A preferred embodiment, as shown in FIG. 7A, is to have VELCRO strips 44 loop through slots 45 in the platform 40 with the strips coming through two slots and the strips 44 holding the pillow on its strips 38.

The pillows 30 can have another VELCRO strip 39 near the top part thereof which runs along a substantial part of its length. There is a strip 39 on each side of its pillow, of opposite type of VELCRO material so that two adjacent pillows can be attached together by means of the strips 39. The strips 39 can be in sections and also can be more vertical in extent. The use of this arrangement has an added advantage in that, for example, if a patient has an open ulcer or any skin area with which no contact with the mattress is desired, then the pillow directly below the bed sore or sensitive area can be separated from its adjacent pillows by separating the VELCRO strips 39 and then pushing down the pillow between two adjacent pillows in the desired area and rejoining the VELCRO when the pillow which is not to be contacted by the patient is pushed down. The new position of pillow which is not to contact the patient will be lower than originally and away from the sensitive area. This result also can be achieved by pushing the pillow very close to the base 40 and refastening strip 44 to the pillow in its new, lower position. Another way to achieve this is by extending the length of the strips 38*a* above the platform strips 44, as shown in FIG. 7A.

As seen in FIG. 7, there is an air supply tube 36 connected to the seal 34 at each end of the pillow. Each tube has a quick disconnect fitting 37 at its end. One tube 36 serves as an inlet and the other as an outlet. These correspond to the passages 16 of the pad 10, one passage on each side of a chamber.

FIG. 7 show the outflow of the air from the individual pillows 30 through the pores 60 as described with respect to FIG. 5. This has an advantage in providing air flow (micromassage) to the patient lying on the mattress. It should also be understood that a single outlet air passage comparable to passage 18 or valve 48 of the pad 10 of FIG. 1 or FIG. 1A also can be utilized or there can be a separate air relief valve such as the valve 48 of FIG. 1A, at the end of the air supply path of a group of pillows for example, 6 to 8. When pillows are used in groups, the air supply can be in parallel to several of the groups so that a double or triple wave effect can be obtained for individual parts of the body. That is, each group of pillows will produce its own peristaltic wave. The wave direction and inflation-deflation rates of each group can be controlled if a parallel set of air supply means and controller valves 24 are used.

When the patient lies on the mattress, the travelling inflation wave can be in the desired direction depending upon the connection of the air supply device and the orientation of the patient. That is, it can be from the shoulders and head toward the feet, or vice versa, as desired.

One of the advantages of the pillow arrangement on the platform as shown in FIGS. 7 and 7A is that a pillow which in some way or other becomes defective or has to be cleaned can easily be removed from the platform merely by disconnecting the air supply tubes at the fittings 37 and removing the pillow from the platform 40. Accordingly, it is not necessary to have to assemble or disassemble a complete bed set up to change, repair or clean a single pillow or several pillows.

Another advantage of the pillow support mattress arrangement of FIGS. 7 and 7A is that it is relatively portable. That is, instead of having to have an inflatable pillows as an integral part of a complete bed with a built in air supply system, the support platform 40 is made of either hinged sections or a flexible material. The desired number of pillows are provided and these can be deflated for minimum storage volume. When it is desired to assemble a mattress on a bed, it is only necessary to put the platform sections down on an existing bed frame, attach the pillows to the platform sections via the complementary VELCRO strips 38, 44 and to connect the air supply exhaust tubes 36 to the pillow fittings 37 in the desired sequence.

Figure 8:
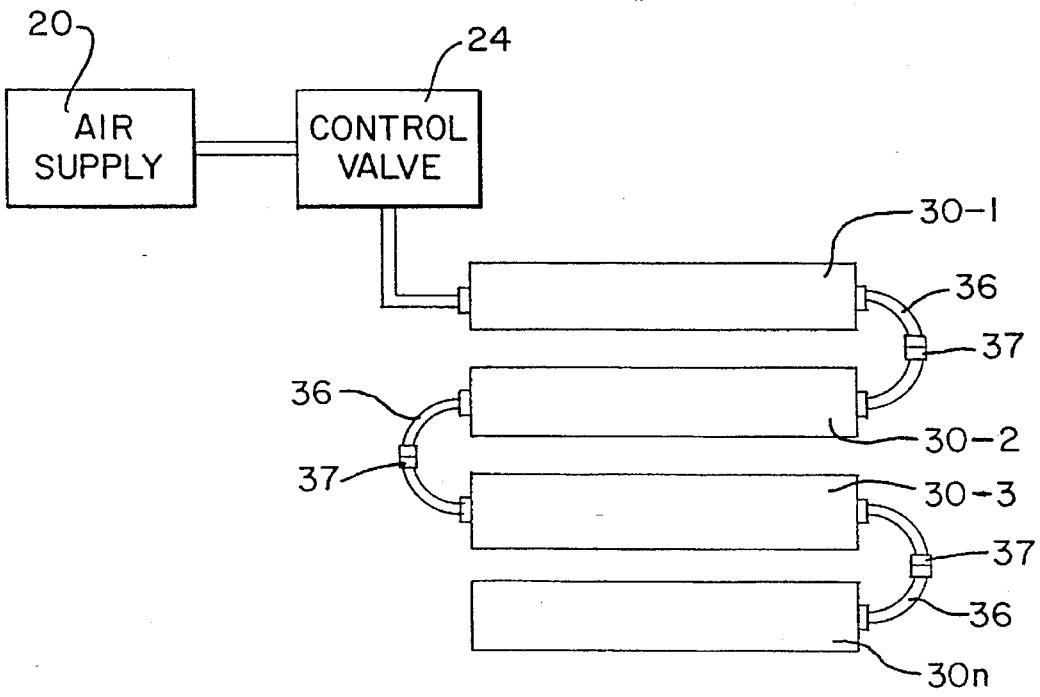
FIG. 8 is a schematic representation of the air supply with inflation-deflation means for the mattress.

FIG. 8 shows inflation of the pillows 30 in a unidirectional travelling peristaltic wave. As can be shown, the pillows are connected sequentially 30-1, 30-2 . . . **30*n*-1, 30*n*,, where "n" signifies any number of pillows as is necessary. The supply tube 36 on one end of the pillow serve as an inlet and the tube on the other end as an outlet. As in the case with the chambers 12, there is a serpentine air flow pattern from pillow to pillow. As explained with respect to the pad 10 of FIGS. 1 and 2, each of the pillows is inflated sequentially so that a travelling peristaltic inflation wave is accomplished from pillow 30-1 through 30**-n.

The number of pillows 30 which are used in a mattress can be selected as desired. It should be understood that the more pillows which are used within a given length bed, the less will be the weight supported by each pillow, meaning that there will be less pressure on the patient from each pillow across the pillow surface area. Also, the greater the number of pillows, the more gradual and gentle will be the effect of the wave. Further, the invention permits a large number of pillows to be connected in sequence. The greater the number of pillows, the less pressure there will be as the patient across the pillow surface area. The less pressure on a patient's body the greater the prevention or healing of bed ulcers, since body circulation is not occluded with a low pressure mattress.

Figure 9:
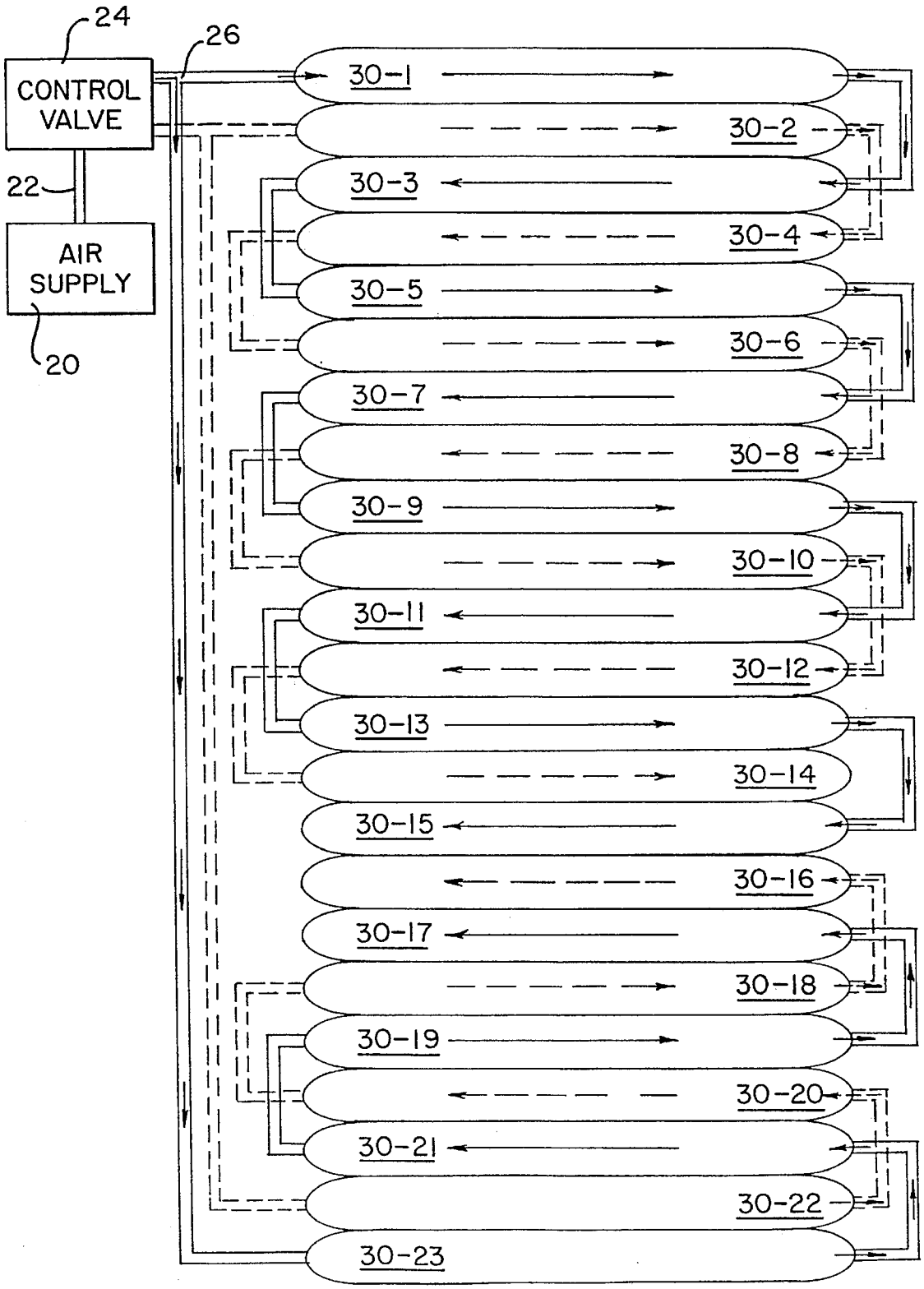
FIG. 9 is a schematic representation of a mattress and air supply for producing cardio-directive waves during inflation.

FIG. 9 shows an arrangement for producing a double peristaltic wave. Here, the output of the outlet of the air valve 24 is supplied to two air circuits. Each circuit is divided into two sections with the sequential inflation beginning at the top and bottom pillows, the inflation going towards the upper ⅔ of the mattress. Illustratively, 23 pillows are shown and connected to form the mattress. The two air circuits are divided into two sections each provided as follows:

Circuit I: Pillows 1-3-5-7-9-11-13-15

Pillows 23-21-19-17

Circuit II: Pillows 2-4-6-8-10-12-14

Pillows 22-20-18-16

The arrows show direction of inflation.

For deflation, each pillow 30 can have holes or pores on top or else there can be an outlet line at the end of each circuit.

The air valve 24 is configured so that at a certain moment it is possible to have air flow through circuit I for a period of time long enough to have all of the pillows in that circuit inflated. Then, the air valve switches to circuit II inflating its pillows and permitting the pillows in the circuit I to deflate. Then it begins the cycle again to inflate circuit I.

Circuit I inflates as follows—first pillows 1 and 23 and then the rest of the pillows in sequence as shown by the arrows. The result is a double peristaltic wave directed toward the heart (if we consider a patient lying (flat) on the mattress with his feet toward pillow 1). That is, one wave goes from the head toward the heart and the other from the feet toward the heart. The heart is approximately at pillows 15 & 16. The peristaltic waves obtained are called cardio directive waves.

When circuit I is shut off by the air valve, circuit II inflates as follows—first pillows 2 and 22 and then the rest of the pillows in the sequence as shown by the arrows in circuit 2. The result is another double peristaltic cardiodirective wave. Instead of using two circuits, a single circuit can be used with the pillows being divided into two groups, say I through 12 and 23 through 13. With this arrangement a double wave can be obtained, one from,the head toward the heart and the other from the feet toward the heart.

Figure 10:
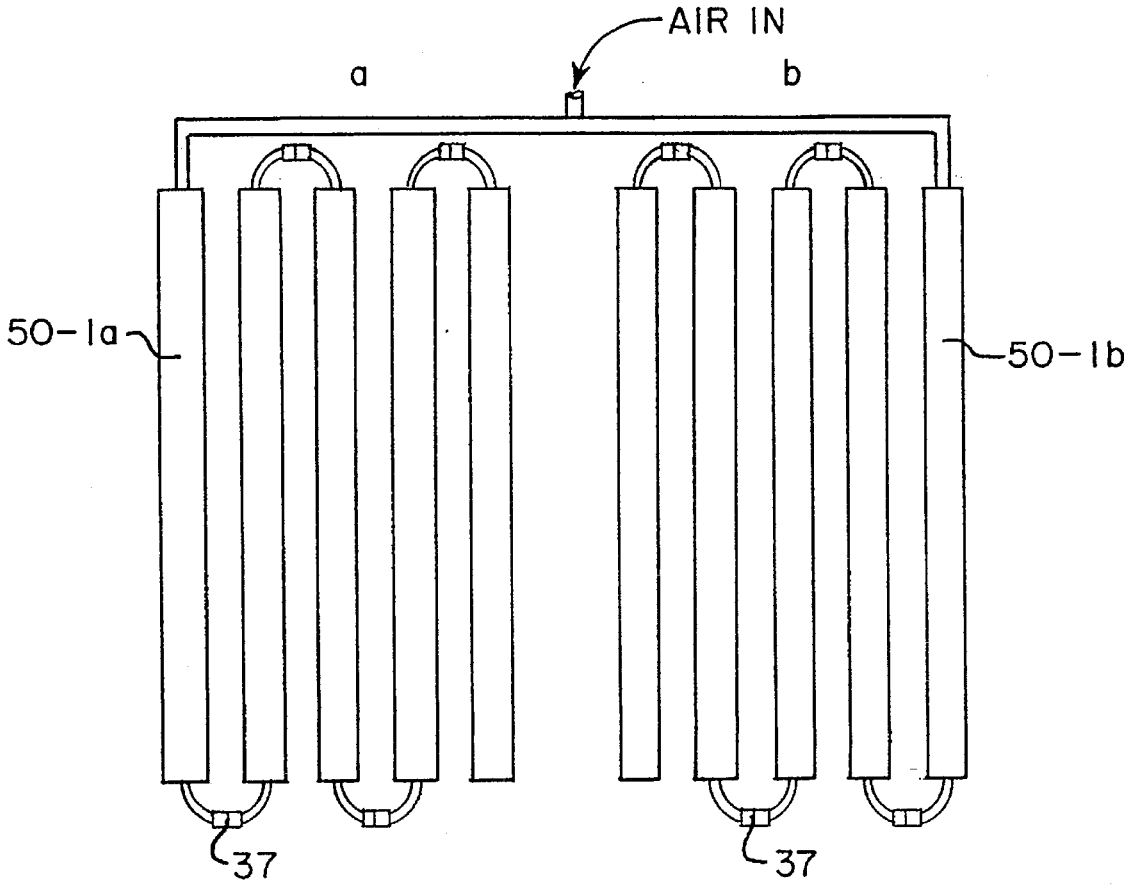
FIG. 10 is a schematic representation of apparatus using the inflatable-deflatable pillows for producing a rocking type motion.

FIG. 10 shows another embodiment of the invention. At times it is desired to impart a rocking or turning motion to the patient. Here, pillows 50 are elongated and extend the length of the mattress. The construction otherwise is as shown and described with respect to FIGS. 6 and 7. The platform sections 40 here preferably would be elongated and foldable along the length of the pillows or along the width as desired.

In FIG. 10, two air supply circuits a and b are shown, one for each of two groups of pillows, five pillows being shown for illustration purposes for each group. The air supply is configured to start inflating from the outer pillow of each group so that two waves will be travelling toward the center. The two waves can start at the same time and work toward the center. This will gradually flex the body of the patient. Alternatively, the air supply can be regulated to separately and alternatively inflate each group of pillows through the use of appropriate valves. This will produce a rocking motion. It is possible to configure the air supply, so that the direction alternates. That is, the mattress will inflate from left to right, thereafter deflate and thereafter inflate from right to left.

While a serial inflation of the chambers of a pad or pillows is shown, it is possible to provide a separate air supply to each chamber or pillow and inflate them on a sequential basis to produce a wave. However, this requires at least multiple air supply valves and outlets.

Figure 11:
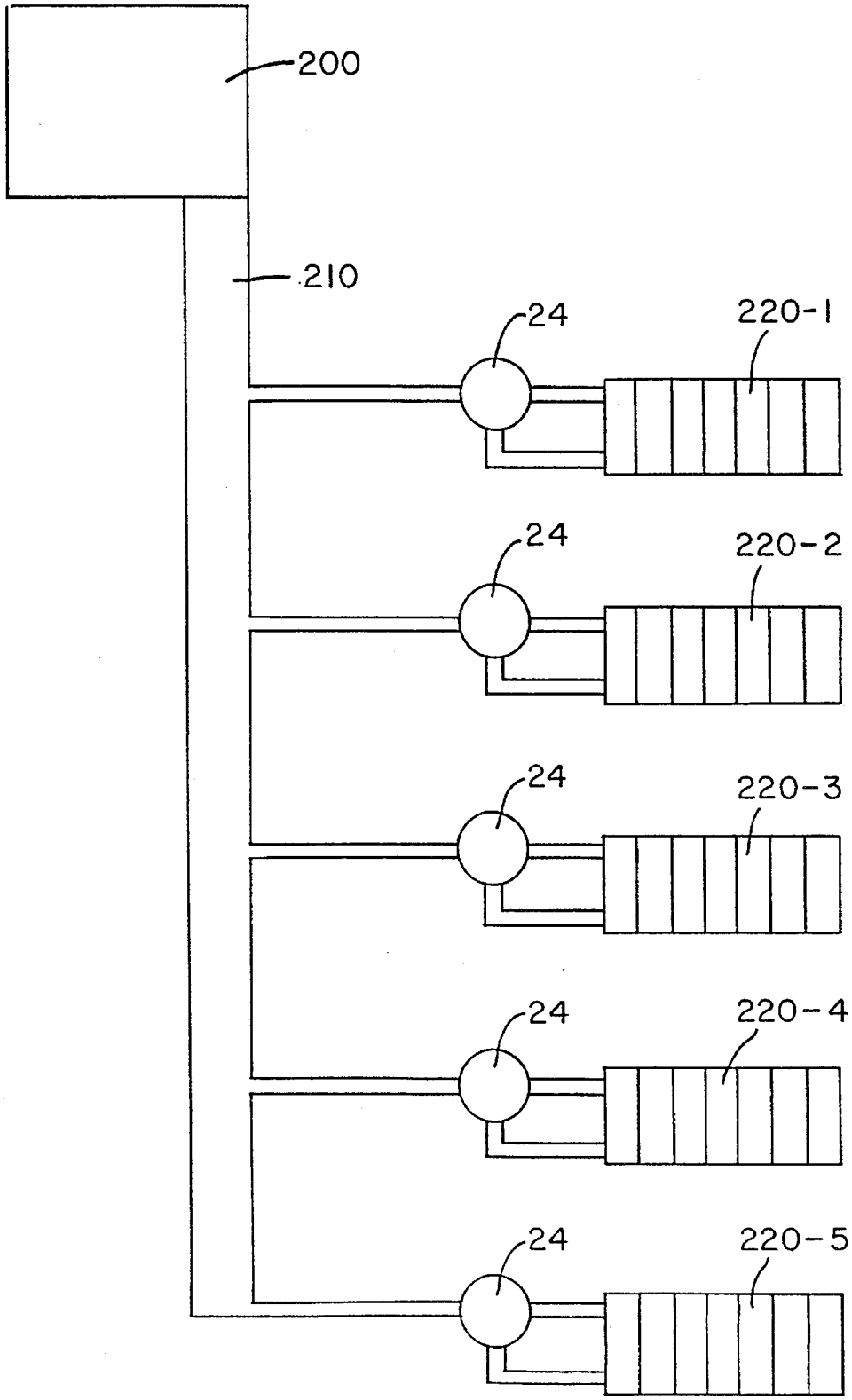
FIG. 11 is a representation of several mattresses connected to one air supply.

FIG. 11 shows a large air compressor or blower 200 with several mattresses 220, such as of the types shown in FIGS. 7–9, connected in parallel to the central air supply line 210 going to the blower. This arrangement can be used in a hospital or part of a care facility where a bed with the support platform can be used at any location merely by connecting to the central air supply line 210. Each mattress would have its own control valve 24.

A novel pad and support has been disclosed using a plurality of chambers or pillows which are connected to inflate sequentially, preferably via a serial, serpentine, air flow pattern. The inflation-deflation cycle of the pad or mattress can be controlled as well as the air supply to control the frequency and intensity of the wave. Also, the chambers can be grouped to produce desired direction of wave travel. If desired, the mattress also can be used without the wave effect. That is, once it is inflated the outlet valve is closed and the chambers are permitted to remain inflated.

Figure 12:
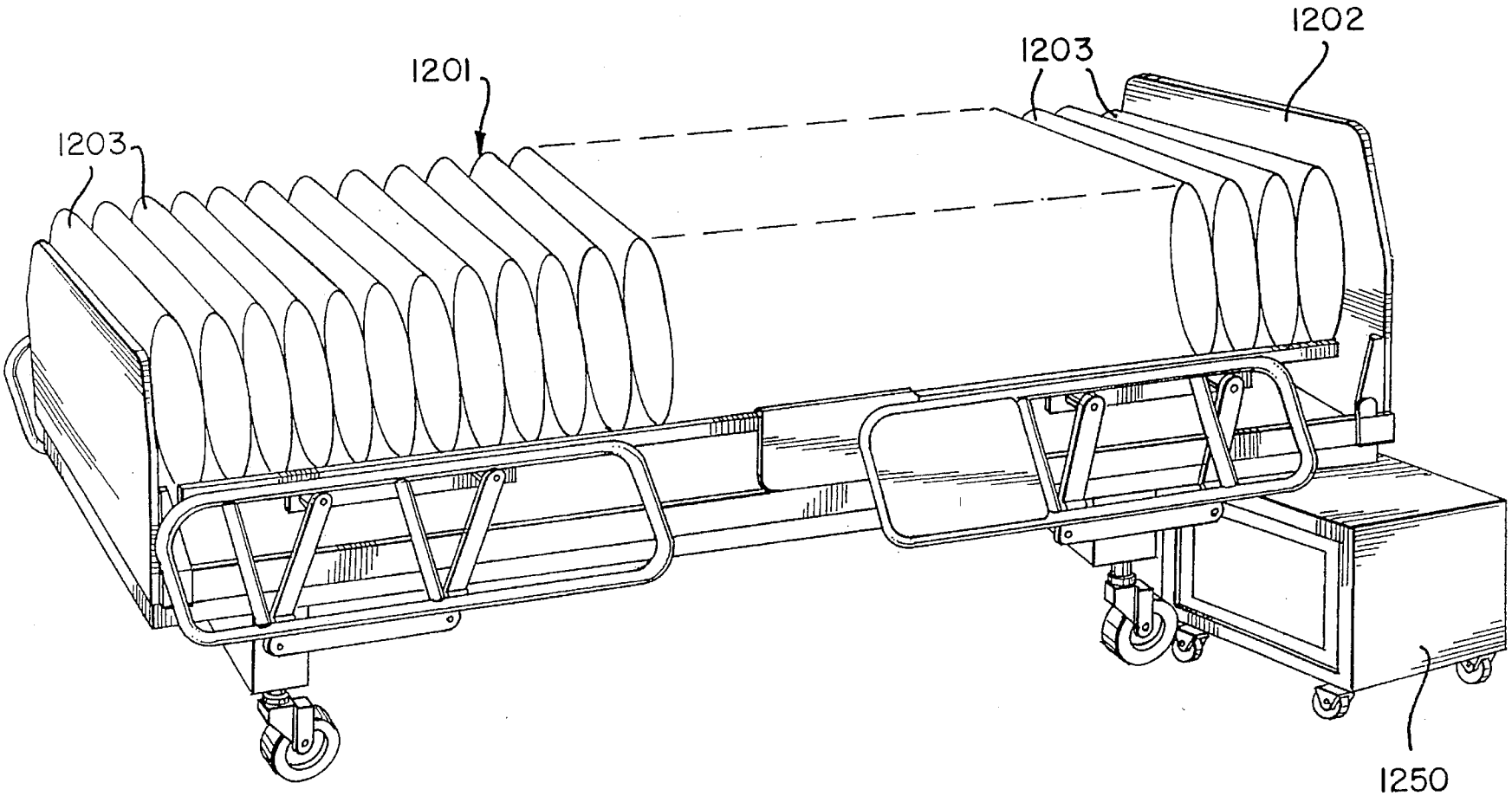
FIG. 12 illustrates a preferred embodiment of the air support mattress of the present invention.

Referring now to FIG. 12, another preferred embodiment 1201 of the present invention is illustrated, installed on a conventional hospital bed 1202. As illustrated, this preferred embodiment is comprised of 28 separate, inflatable pillows 1203, preferably made of a breathable material such as GORETEX, mounted on support members 1424 (shown most in FIGS. 13–14, and 18–22) laterally arranged down the length of the bed 1202.

The pillows 1203 may also be made of a disposable material such as TYVEK and sterilized and treated with an antibacterial medicine. The air support mattress 1201, when used with these disposable and medicated pillows 1203, is suitable for use with persons who require maximally sterile conditions, such as burn victims. After these pillows 1203 are used by such a patient, the pillows 1203 can be replaced with new pillows 1203.

Figure 13:
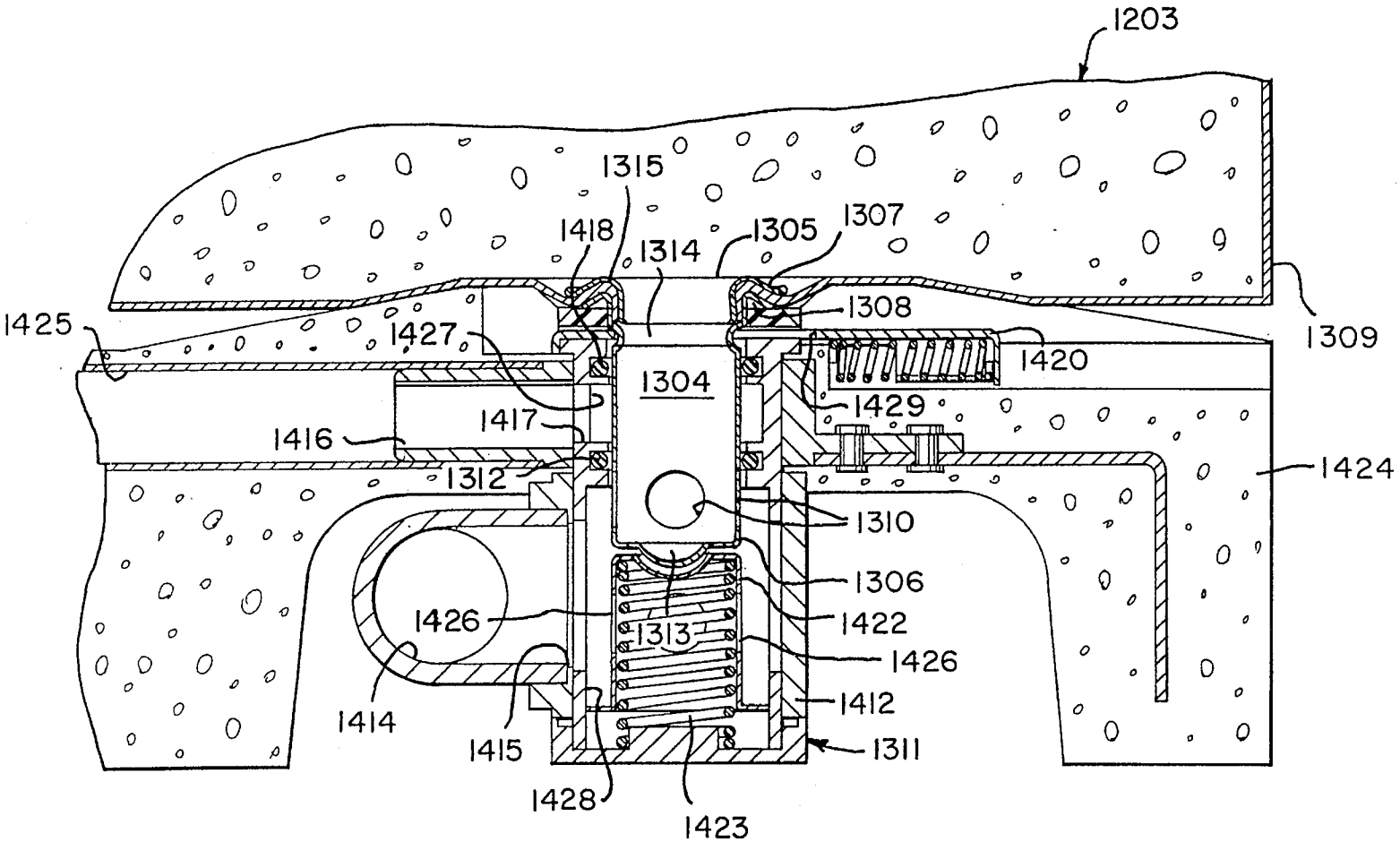
FIG. 13 is a sectional elevational view of the connection valve assembly as connected to a pillow's male portion installed therein.
Figure 14:
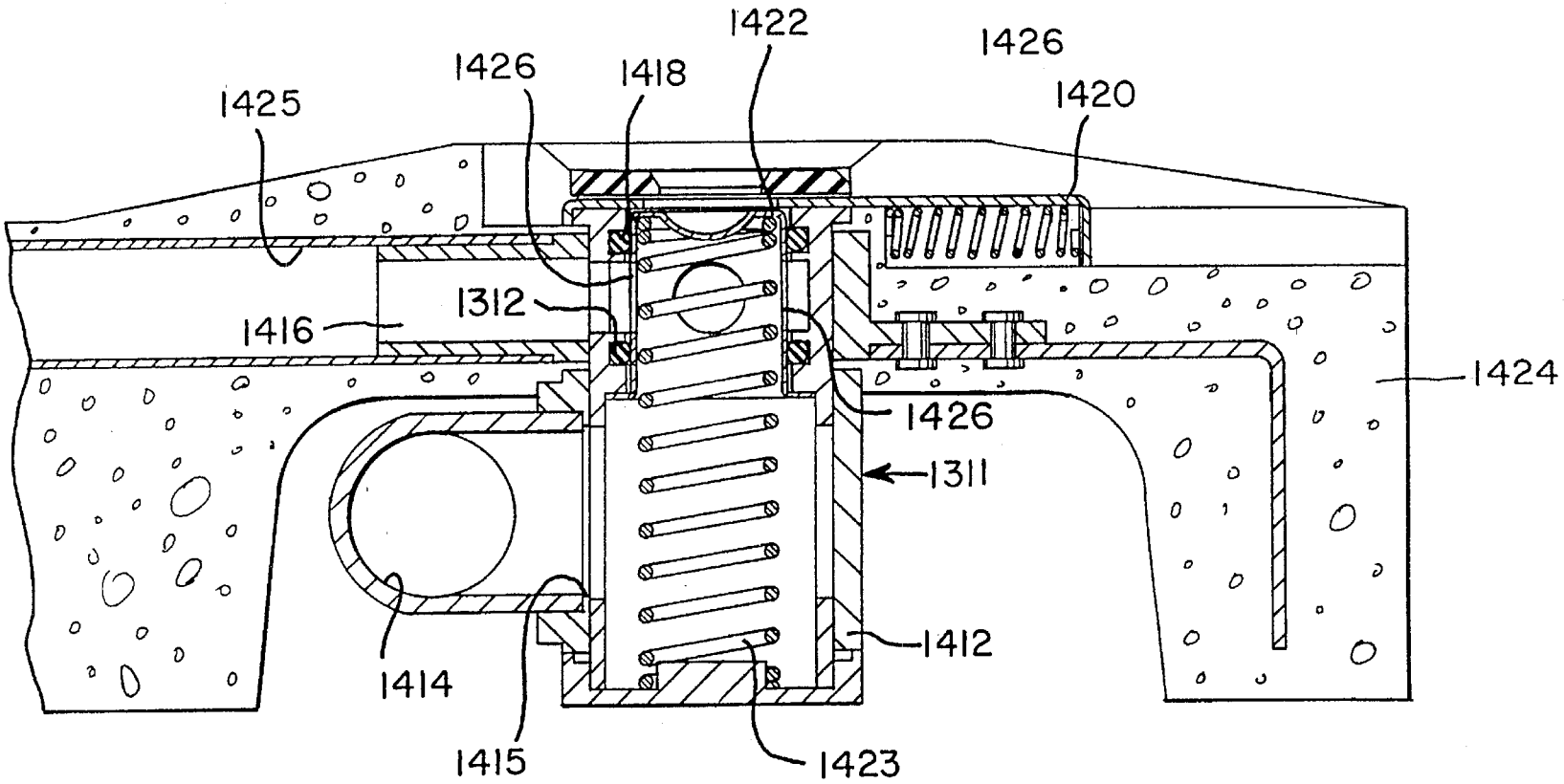
FIG. 14 is a sectional elevational view of the connection valve assembly.

Referring now to FIGS. 13 and 14, a preferred structure for interconnecting each of the pillows to the airflow supply and exhaust lines provided by the support members is shown, first with a pillow 1203 in place (FIG. 13) and then with the pillow removed (FIG. 14).

The pillow 1203 shown in FIG. 13 comprises the outer pillow material 1309 joined to a hollow cylindrical male fitting 1304, with one of such male fittings 1304 being attached at each end portion of each pillow 1203 along its bottom edge. The male fitting 1304, preferably constructed from a sturdy material such as metal, is connected in sealing engagement to the bottom of the pillow and includes an open upper end 1305 which opens in fluid communication into the inner portion of the pillow 1203. The fitting 1304 also includes a downwardly extending closed end 1306 which is provided with a nipple 1313 for centering the fitting on a cap 1422 partially enclosing a coiled spring 1423, the functions of which will be described below. Also at the lower end of the fitting 1304 and spaced around the cylindrical wall are a plurality of through holes 1310 through which air may pass for either filling or deflating the pillow 1203. Finally, a circumferential groove 1314 is provided at the upper end of the male fitting 1304 for the purpose of locking the fitting in place as will be explained.

The upper end of fitting 1304 is shaped to form a flange 1308. A separate ring element 1315 is provided with a similarly shaped flange 1307 which captures and seals the pillow material 1309 between itself and the flange 1308 when the ring element 1315 is placed in the open upper end 1305 of the male fitting 1304. Any suitable mechanical and adhesive joining techniques are used to complete the attachment of the male fitting 1304 to the pillow 1203.

As shown in FIG. 13, the fitting 1304 is slidably, releasably locked in position in a valve assembly 1311 comprising a generally cylindrical housing 1412 which is divided generally into an upper chamber 1427 and a lower chamber 1428. The chambers 1427 and 1428 are sealed from one another by a circumferential resilient sealing member 1312 such as an o-ring. Another resilient o-ring 1418 provides a seal between the upper chamber 1427 and the circumferential locking groove 1314 which is located at a higher position on the fitting 1304.

As shown in FIG. 13, when the male fitting 1304 is in locked position in the housing 1412, the nipple 1313 centers within a coil spring 1423 to compress that spring. As shown, the nipple does not actually engage the spring 1423 but instead engages a spring cap 1422 which partially covers and travels upwardly and/or downwardly with the upper end of the spring 1423. The cap 1422 is provided with a corresponding dimple for receiving the nipple 1313 of the male fitting 1304.

The cap 1422 is hollow and open at its lower end for permitting the spring 1423 to pass out thereof, with the spring ultimately engaging the lower end wall of the housing 1412. The cap 1422 is provided with a plurality of holes 1426 through its cylindrical sidewall, the purpose of which will become clear below.

As is further seen from FIG. 13, a resiliently biased slide lock 1420, which may comprise a flat metal element has an elongated opening or hole 1429 formed therein for receiving and engaging the groove 1314 at the upper end of the male fitting 1304. As shown, the slide lock is biased toward a position where one portion of the hole 1429, which is smaller in diameter than the diameter of the male fitting 1304, engages the groove 1314 thereby retaining the fitting 1304 in place. When the slide lock 1420 is moved to an unlocking or disengaging position (to the left in FIG. 13), a larger diameter portion of hole 1429 centers over fitting 1304. Thus, the coil spring 1423 is free to extend upwardly against cap 1422 and thereby against the male fitting 1304 to eject the fitting from the housing 1412.

Other suitable locking mechanisms may be employed. In particular, other locking systems are envisioned in which the male fitting 1304 may be inserted into the housing 1412 without the necessity of moving the slide lock 1420 out of its resting, interfering position. Substitution of this or other "quick connect" type locking mechanisms are well within the abilities of ordinarily skilled artisans.

Part of the valve assembly 1311 and connected to or integrally formed with the housing 1412 is a relatively large tubular airflow member 1414 which is in fluid communication with the lower chamber 1428 of the housing 1412 through a flow opening 1415 in the housing wall. It is through this flow member 1414 that air passes in order to inflate and/or deflate the pillow 1203. As shown in FIG. 13, in its installed condition, a continuous airflow path is provided from airflow member 1414, into the lower chamber 1428 of the housing 1412, then through holes 1310 and up through the hollow center of the male fitting 1304 and finally through open end 1305 and into the interior portion of the pillow 1203.

It will be remembered at this point that the pillows inflate and deflate in a serpentine fashion, with air flowing into one end of a pillow and filling that pillow, and then flowing from the other end of that same pillow to the next pillow. It is thus necessary that an alternative flow path be provided for inflation and deflation of successive pillows even when one or more pillows are removed from the support member 1424 which forms the air mattress support. This alternative flow path is seen in FIG. 13 and more clearly in FIG. 14, to which reference is now made.

The support member 1424 is provided with at least one airflow tube 1425 formed therein. In a preferred embodiment, there are two such tubes 1425 integrally formed in the support member 1424, as is more easily seen in FIG. 18. These airflow tubes 1425 may comprise separate tubular structures molded into the support 1424. Each tube fluidly communicates the upper chamber 1427 of a housing 1412 with a respective upper chamber of a similar housing mounted within the opposite end of the support member 1424. As seen in FIG. 14, when the pillow is removed, coil spring 1423 causes the cap 1422 to extend to an upper position in which the holes 1426 in the cap come into alignment with the opening 1427 from the upper chamber 1417 into the tube 1425. A tubular support 1416 is shown as providing the connection between the housing 1412 and the tube 1425. In this matter, a continuous airflow path is provided from flow member 1414, into the lower chamber 1428 of the housing 1412, then through the cap 1422 and into the flow tube 1425 through the upper chamber 1427 and the opening 1417 in the upper portion of the housing 1412. Accordingly, air will flow from the upper chamber of a housing at one side or at one end of the support 1424 to a similar upper chamber located at the other end of the support, when the pillow 1203 is not installed. When the fitting 1304 is installed, as in FIG. 13, this alternative flow path is closed by the cylindrical side wall of filling between o-rings 1312 and 1418. As seen in FIG. 14, however, the cap in conjunction with the upper o-ring 1418 serves to seal the otherwise open end of the housing 1412 when the pillow 1203 is removed.

Figure 15:
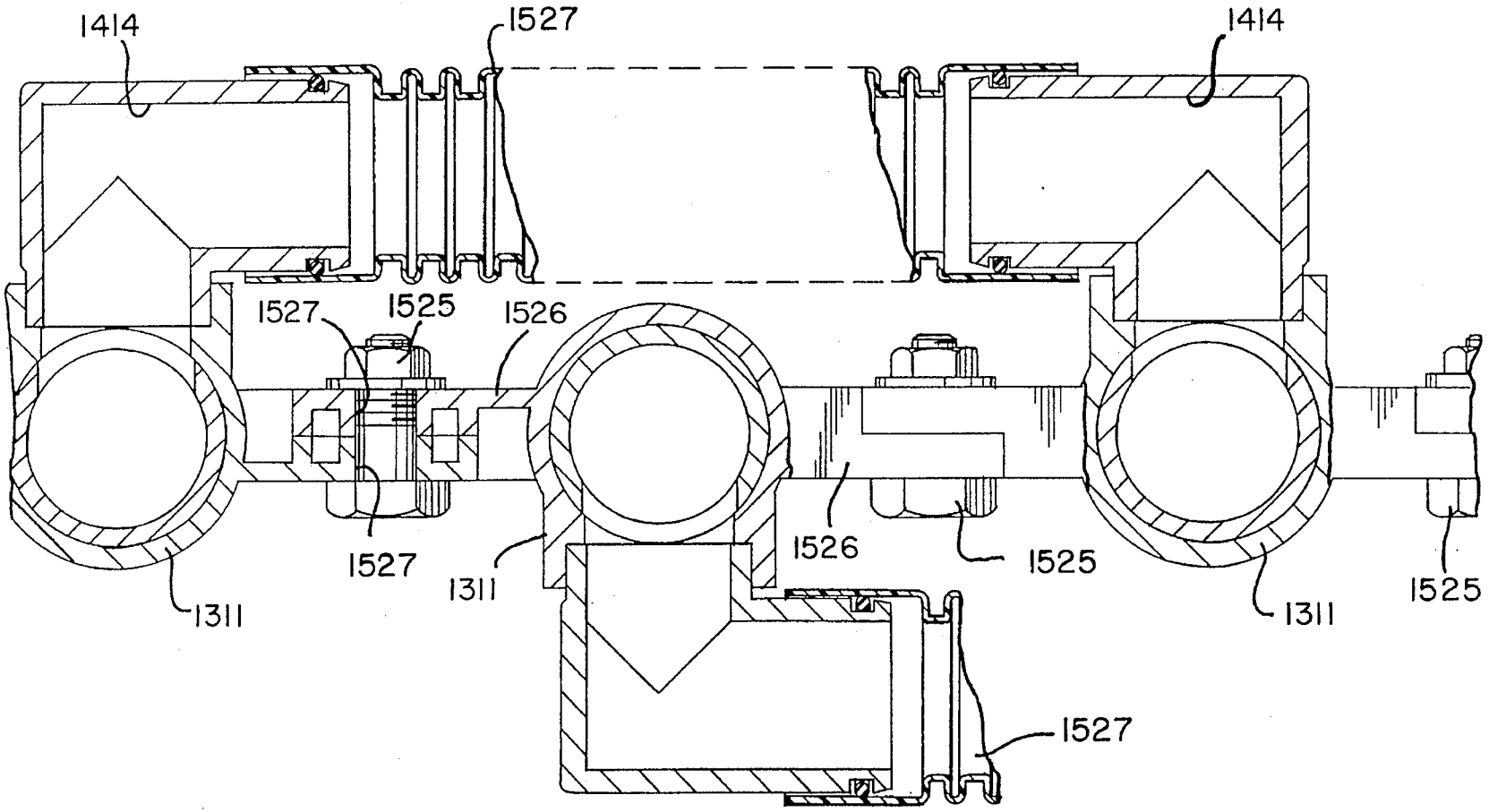
FIG. 15 is a sectional plan view of connection valve assembly connectivity.

FIG. 15 illustrates the connectivity between the support members 1424. As clearly illustrated, each housing 1412 includes two preferably integral outwardly extending side pieces 1526 positioned at opposite sides of the housing 1412, each of the side pieces having a hole 1527 therethrough. Each of the support members 1424 are hingedly connected to adjacent support members 1424 using the side pieces 1526 by positioning housings 1412 adjacent to one another so that the side pieces 1526 of adjacent housings 1424 overlap and their respective holes 1527 are in alignment. The adjacent side pieces 1526 are then hingedly connected with a connecting means 1525 such as a bolt and nut.

Also, each flow member 1414 is communicatively connected to another flow member 1414 via a flexible tube 1527, the latter of which is mounted to a support member (not shown) that is preferably two support members away so that an air flow path is provided between their respective housings 1412. Thus, the housings 1414 are connected to each other in an alternating fashion so as to provide the serpentine air flow pattern of the invention, as more clearly shown in FIG. 16.

Figure 16:
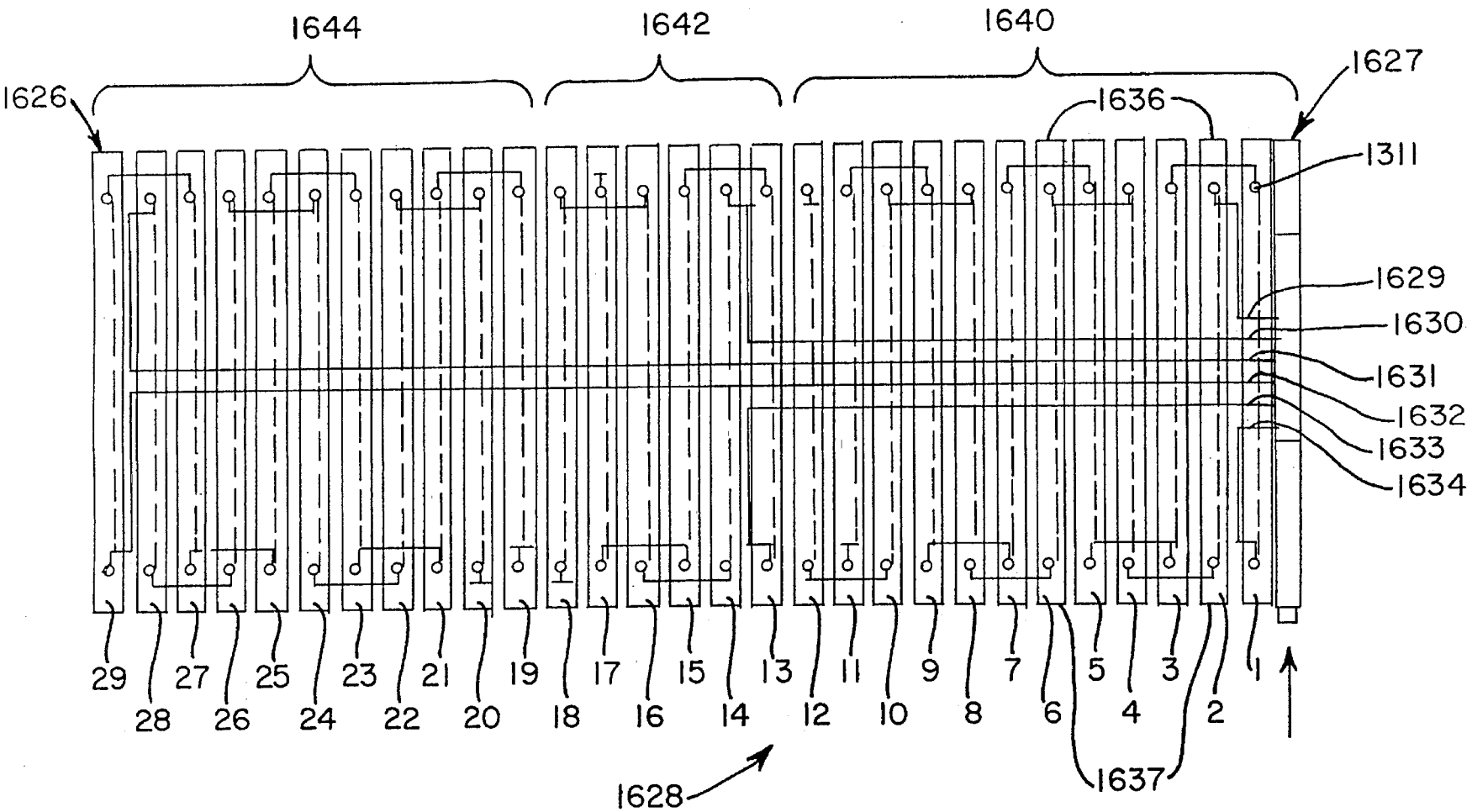
FIG. 16 illustrates the preferred air flow paths of the present invention.

The preferred connection paths between the numerous flow members 1414 and their respective housings 1412 is illustrated in FIG. 16. Support members 1–29 are laterally arranged with respect to the head 1626 and the foot 1627 of the air support mattress 1628. Preferably, the air support mattress 1628 is comprised of six air flow connection paths 1629–1634. As shown, the first air flow connection path 1629 provides an air flow path through support members 2, 4, 6, 8, 10, and 12, that is, in the foot section 1640 of the mattress 1628. In particular, air flows through a housing 1412 mounted on a first end 1636 of support member 2, through either a pillow 1203 or support member 2 (if a pillow 1203 is not mounted) to a housing 1412 mounted on a second end 1637 of support member 2 to housing 1412 mounted on a second end 1367 of support member 14, etc.

The second serpentine air flow path 1630 is similarly provided through support members 14, 16, and 18. The third serpentine air flow path 1631 includes support members 28, 26, 24, 22, and 20. The fourth path 1362 includes support members 29, 27, 25, 23, 21, and 19. The fifth path 1363 includes support members 13, 15, and 17. Finally, the sixth serpentine air flow path 1634 includes supports 1, 3, 5, 7, 9, and 11. The first described flow path 1629 and the sixth path 1634 serve to inflate/deflate the pillows of the foot section 1640; the second path 1630 and fifth path 1633 serve the mid-section 1642 of the mattress 1628; and the third flow path 1631 and fourth path 1632 serve the head section 1644.

As can be easily determined from FIG. 16, an air wave motion can be accomplished by selectively forcing air through one or more of selected air flow paths 1629–1634, and/or selectively allowing air to be exhausted through one or more of selected air flow paths 1629–2634. For example, simultaneously applying air to airflow paths 1629 and 1634, and air flow paths 1631 and 1632 will effect a double peristaltic cardiodirective wave. Further, by selecting inflating and deflating even/odd combinations of pillows 1203 at a selected frequency will continually change the area of the skin of a patient that is subjected to pressure. Also, pillows 1203 connected through air flow paths 1630 and 1633 can be deflated to allow for insertion of a bed pan under the patient.

Figure 17:
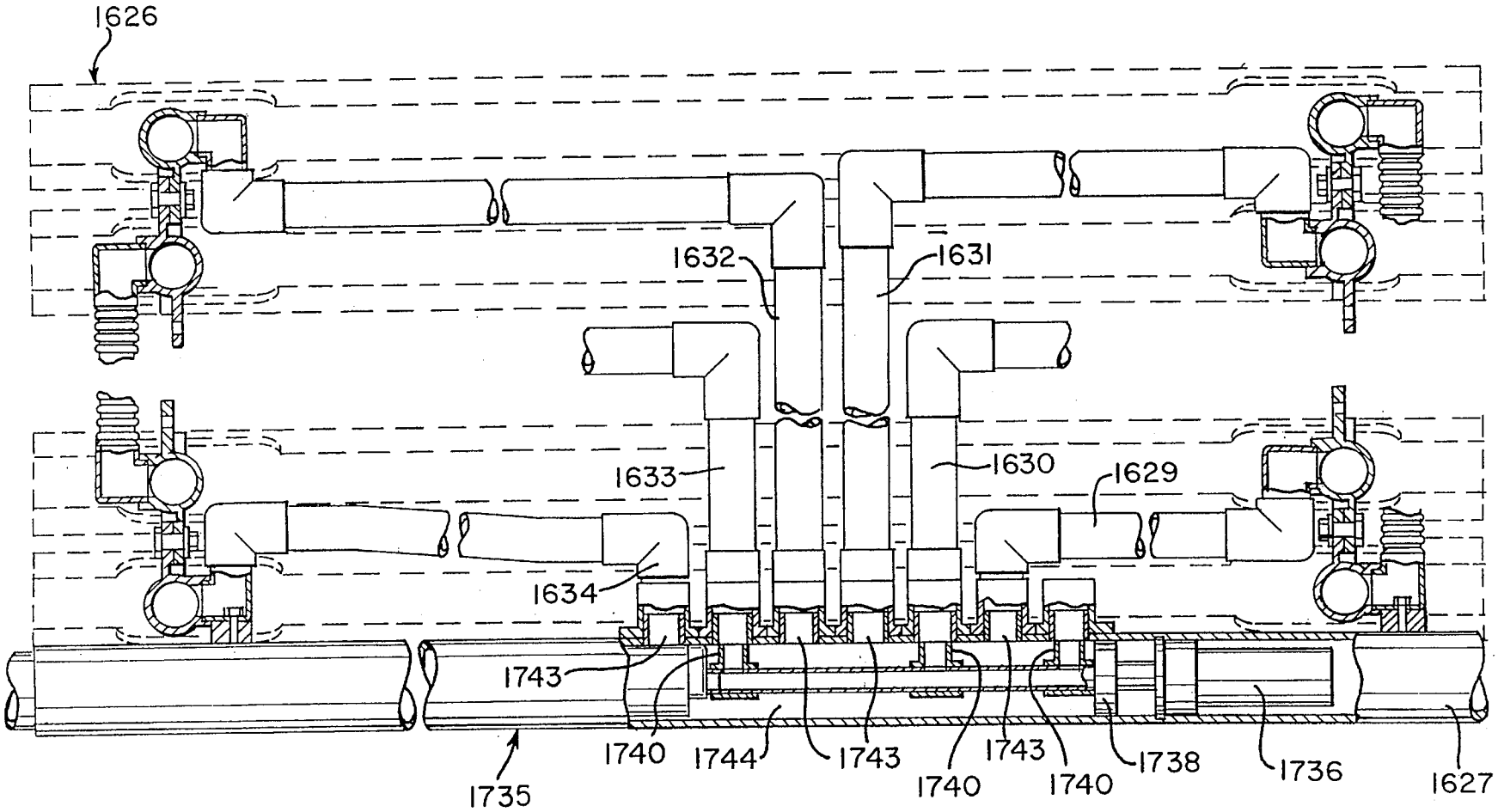
FIG. 17. is a sectional plan view of the rotary valve assembly and the air flow paths of the present invention.

FIG. 17 illustrates (in part) the rotary valve assembly 1735 driven by motor 1736, for selectively applying air to air flow paths 1629–1634, and for selectively exhausting air from the air flow paths 1629–1634, which assembly 1735 is preferably positioned at the foot 1627 of the air support mattress. The five position (preferred) rotary valve assembly 1735 is preferably controlled by a microcontroller under the direction of a user in any well-known fashion.

In a presently preferred embodiment, air is applied to a chamber 1744 of the rotary valve assembly 1735 at an end 1737 opposite the motor 1736. Motor 1736, preferably a small DC motor, selectively rotates an inner cylindrical valve member 1738 which applies air or exhausts air to selected air flow paths 1629–1634. The valve member 1738 comprises a chamber 1744 and five circumferentially spaced sets of holes 1743, each set of holes 1743 having its members spaced longitudinally along the side of the valve member 1738. The holes 1743 provide fluid communication between the chamber 1744 and selected air flow paths 1629–1634.

The valve member 1738 additionally comprises three exhaust tubes 1740 connected to an exhaust manifold 1744 for exhausting air from the seat area, that is, air flow paths 1630 and 1633 through a vent 1746. The valve member 1738, positioned as illustrated in the figure, is in "SEAT deflate" mode, quickly exhausting air from the seat area via air flow paths 1630 and 1633 aligned with the exhaust tubes 1740 while simultaneously applying air to the remaining air flow paths, 1631, 1632, 1629, and 1634 through holes 1743 aligned therewith.

The remaining four positions, not shown, include an "EVEN inflate" mode, wherein air flow paths 1629, 1630, and 1631 are aligned with a set of open holes 1743 so as to allow air to be communicated from chamber 1744 to only the even numbered pillows. Since the remaining air paths, i.e., those leading to the odd numbered pillows, are not being supplied air, they tend to slowly lose air as they are made of a breathable material.

Also included is a position for "ODD inflate," wherein air flow paths 1634, 1633, 1632 are aligned with open holes 1743; "ALL inflate," wherein all air flow paths except vent 1746 are aligned with open holes so as to inflate all pillows; and "QUICK deflate" wherein all airflow paths 1629–1634 and vent 1746 are aligned with holes 1743 so that air from all paths will quickly escape from the vent 1746. Note that the exhaust manifold 1744 and the tubes 1740 are used only in "SEAT deflate" mode.

Referring now additionally to FIG. 12, the air flow is supplied and controlled by a console 1205. An AC line operated DC power supply and microcontroller based control electronics are contained within a removable drawer in console 1250 for ease of service. A blower, preferably comprised of a 400W brushless DC motor having three stages and capable of outputting 50 liters/second of air, and an air filter, preferably a HEPA-type, for providing an air flow, are enclosed within a soundproofing baffling in the middle section of the console 1250. The console may also include a rechargeable battery pack to operate the blower motor in case of AC power loss, and a heater and a cooler for warming or cooling the air supplied to the air support mattress.

The control system comprises an 80C51FA microcontroller running in extended configuration at 11.059 MHz. It is supported with 32K bytes of battery backed CMOS RAM for data storage, and 64K bytes of CMOS EPROM for program code storage. The control system controls not only the blower unit and rotary valve assembly 1735, but also monitors and controls the pressure of each pillow and the temperature of the air at the rotary valve assembly 1735.

Pressure in each of the pillows 1203 is measured by a solid-state differential pressure transducer, preferably a Sensym SX01DN, referenced to the ambient air pressure. The signal from the pressure sensor is amplified, filtered, A/D converted, and then applied to the microcontroller. One skilled in the art will understand that the microcontroller is easily programmed to analyze the pressure signal and control the blower accordingly. For example, the speed of the blower's motor can be controlled by the 0–10V DC analog output derived from a PWM signal provided by the microcontroller. With the PWM operating at 16 KHz, the signal can be filtered to produce a proportional DC output voltage to be applied to the blower motor.

Temperature is preferably sensed by temperature sensor LM35 IC's located in the rotary valve 1735 located in or near one or more of the airflow paths 1629–1634. Preferably, there is an additional temperature sensor placed in the electronic selection of the console, to provide a reference for ambient air temperature.

The signals from the temperature sensors are preferably amplified, filtered, A/D converted, and applied to the microcontroller. One skilled in the art will understand the microcontroller is easily programmed to analyze the various temperature signals and to control the heater and cooler accordingly.

The heater preferably comprises AC line operated electric heating elements and solid-state relays responsive to PWM control from the microcontroller. A self-resetting thermostat with a limit temperature of 150° F./115° C. and a one-time non-resettable thermal fuse with a limit temperature of 175° F./130° C. preferably provide safety cutoffs to remove power from the heater elements upon the occurrence of excessive temperature.

The cooling unit preferably comprises thermoelectric elements (Peltier device) and associated solid-state relays. The cooling unit also preferably controls safety cutoffs for removing power to the thermoelectric elements upon the occurrence of too low a temperature.

Figure 18:
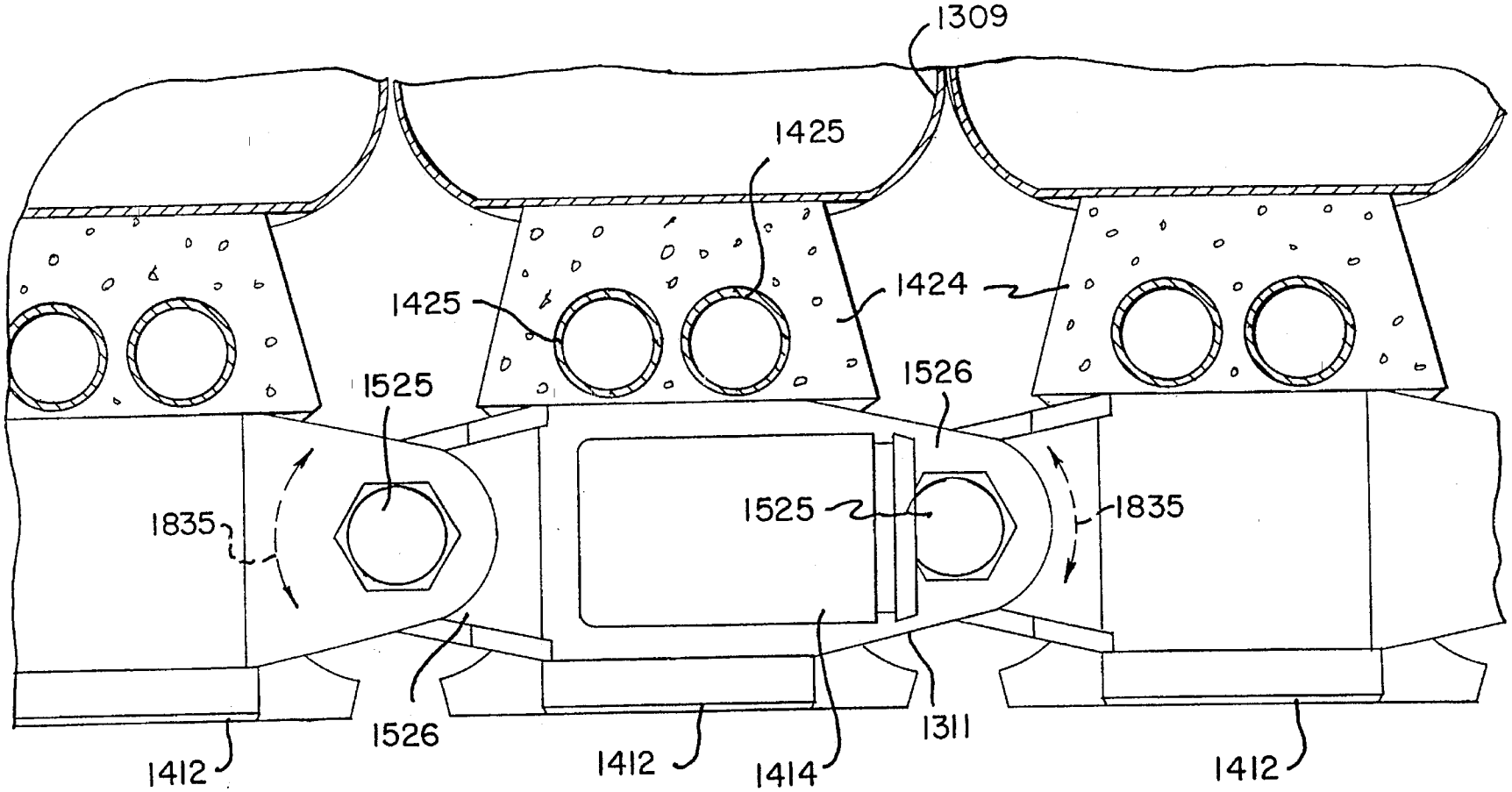
FIG. 18. illustrates a sectional elevational view of the hinged connections between connection valve assemblies.

As described in connection with FIG. 15, the support members 1424 are hingedly connected to adjacent support members 1424. FIG. 18 is a sectional plan view of the housings 1412 and their respective support members 1624. As is shown, side pieces 1526 of adjacent housings 1412 are hingedly connected via connecting means 1525. The air support mattress 1201 is thus arranged in a flexible, segmented fashion. Arrows 1835 illustrate the preferred direction of the swing of the hinge connections.

Figure 19:
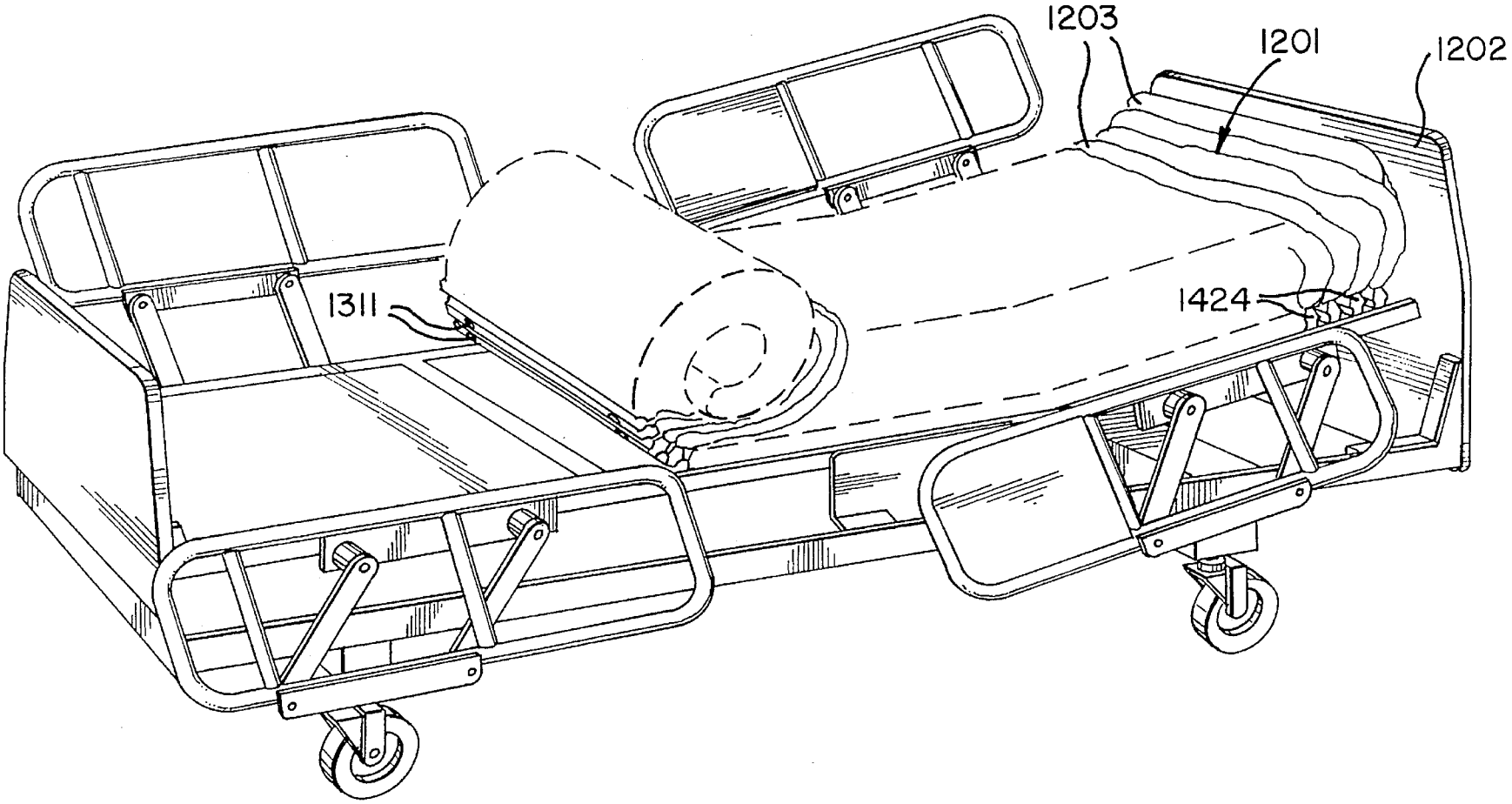
FIG. 19. shows the preferred air support mattress is a partially installed condition.

With the housings 1412, and thus the corresponding support members 1424 and pillows 1203, connected in the manner described in connection with FIG. 15, the mattress can be quickly and easily installed on or removed from a standard hospital bed frame. Referring now to FIG. 19, a preferred embodiment of the air support mattress 1201 is shown, with pillows 1203 deflated, in a partially installed state. Note that the hinged connections between the housings 1412, and additionally the flexible tubes 1527, allow the air support mattress 1201 (with pillows 1203 deflated) to be easily rolled and unrolled on a standard hospital bed frame 1202.

Figure 20A:
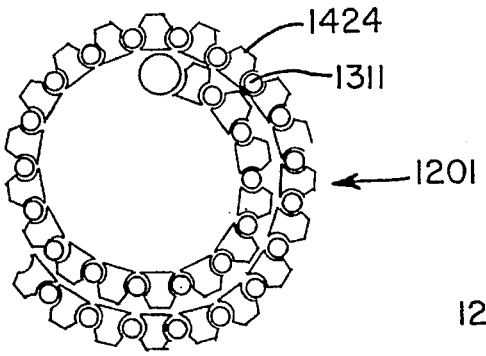
FIG. 20. is a schematic representation of the preferred air support mattress as rolled for storage or transporting.
Figure 20B:
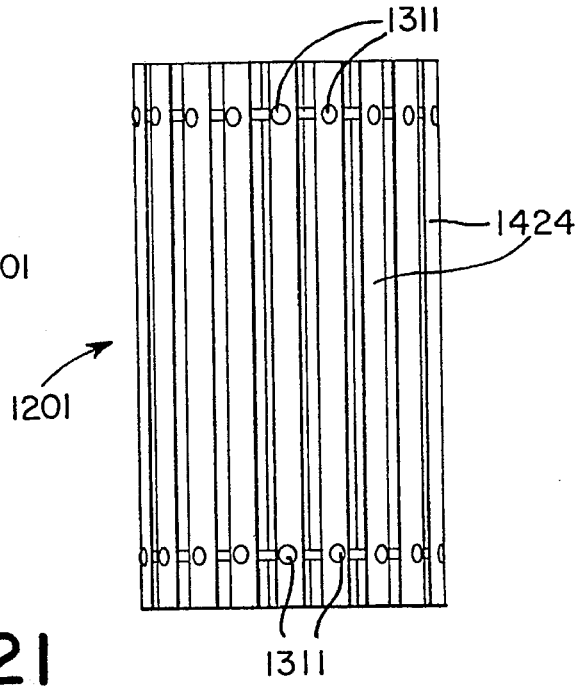

FIGS. 20*a* and 20*b* illustrates the air support mattress 1201 in a fully rolled state. As will be easily understood by those skilled in the art, the fully rolled mattress is easily stored or transported.

Figure 21:
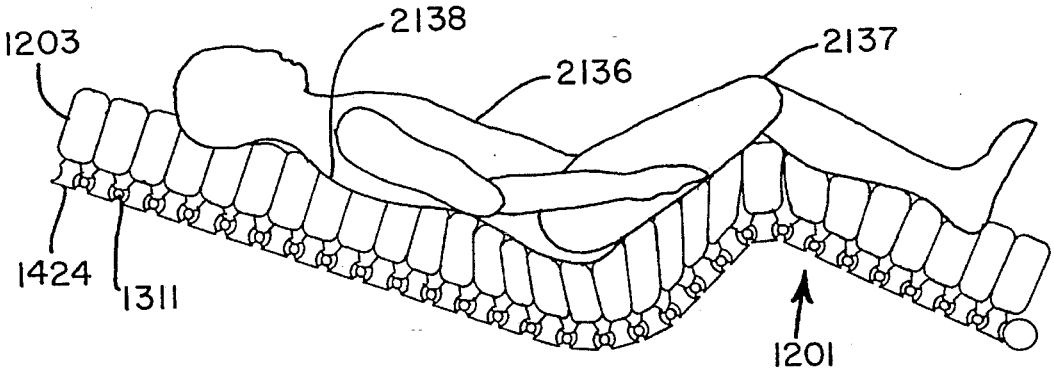
FIG. 21 illustrates the flexibility of the preferred air support mattress structure.
Figure 22:
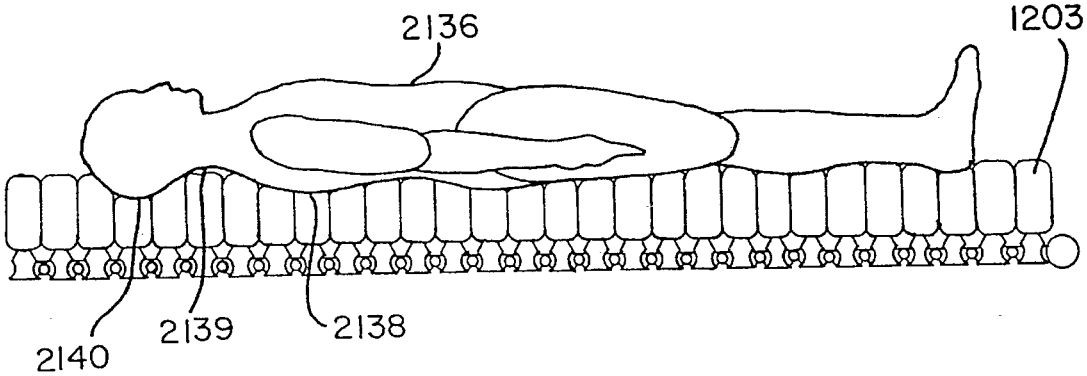
FIG. 22 illustrates a patient on the preferred air support mattress in a fully horizontal position.

FIGS. 21 and 22 show further benefits to the structure of the preferred embodiment of the air support mattress 1201. As illustrated, the air support mattress 1201 conforms to an infinite number of positions, primarily as a function of the position of the underlying hospital bed frame (not shown). FIG. 21 shows a patient 2136 with knees 2137 raised and back 2138 inclined, fully supported by the air support mattress 1201.

FIG. 22 shows the patient 2126 is a horizontal position. The pillows 1203 conform the shape of the patient 2136, particular at the back 2138, neck 2139, and head 2140.

In another embodiment, a foam insert 2301 is utilized in the pillows of the present invention. Referring to FIG. 23, a soft, open cell or air porous foam insert is provided, sized to fit in the inside of a pillow 1203. The insert may alternatively be made from any foam-like material, provided it is air porous. The foam is preferably cut into a rectangular solid shape with rounded edges. As shown in FIG. 24, the pillow 1203 is formed around the foam insert 2301, with the inside surfaces of the pillow 1203 adhered to the foam insert 2301. The inside surfaces of the pillow 1203 are preferably adhesively attached to the foam insert 2301, but one of ordinary skill in the art will recognize that the adherence may be accomplished by other means such as sewing. The foam inserts 23 provide a means for the pillows 1203 to retain their shape, even without air pressure. When air is applied to the pillow 1203 and its respective foam insert 2301, the pillow 1203 becomes firmer and may actually expand to some degree.

The use of the foam insert 2301 has several advantages. First, the insert 2301 prevents the pillows 1203 from bulging in width, which prevents the support mattress from expanding lengthwise and straining against the head and foot boards. In this manner, upward arching of the mattress is avoided. Also, the pillows 1203 are retrained from bulging in height, so that the top surface of the mattress is substantially flat.

Another advantage of the foam insert 2301 is that it allows pillows 1203 that are not having air applied to them to remain in their proper positions. Thus, when air is applied, the pillows 1203 will not move substantially.

Still another advantage of the foam insert 2301 is that it provides a minimum support to a user. In particular, a heavy person will be substantially guaranteed not to "bottom out," that is, a heavy person will not cause the upper portion of the pillow to contact the bottom portion of the pillow.

Finally, the foam insert 2301 will provide a minimum support to a user, even when air is not being applied to the pillows. Thus, during a power outage, or while transporting a person and power is not available, the user will be relatively comfortably supported on the pillows 1203.

Another enhancement to the present invention is illustrated in FIGS. 25 and 26. A protective cover 2501 is provided for the pillows of the air support mattress. The cover 2501 is, preferably made of an inexpensive, lightweight, and liquid-impermeable material, such as TYVEK, is sized to fit over or cover each of the pillows in the air support mattress. As illustrated, the cover 2501 includes an open bottom 2502 to allow for the insertion of the pillows.

The cover 2501 preferably includes a drawstring or elastic band at its bottom edge 2503 which serves to tighten or partially close the bottom 2502, once the pillow is inserted, to secure the cover 2501 in place. As clearly shown in FIG. 26, the bottom edge 2503 of the cover 2501 is preferably tightened below the bottom of the pillow 1203 so that the top, sides, ends, and at least a portion of the bottom suface are protected with the cover 2501.

The cover 2501 is quickly and easily installed over each pillow 1203. It can easily be ascertained from the figures that the covers 2501 may be fitted on the pillows while the pillows 1203 are in any condition, such as inflated or deflated, installed, or not installed.

The novel cover 2501 provides several important advantages, particularly in the hospital environment. First, the covers 2501 provide protection for each of the individual pillows 1203 against bodily soils and liquids from the patient. Also, these covers 2501 are quickly and easily removed and replaced. When made from a disposable material such as TYVEK, no laundering is required. Soiled covers are simply discarded and replaced with new covers.

Another advantage is that each of the covers may be made of a sterilizable material. This provides additional protection for patient against infection which is especially importanct for burn victims and AIDS patients. Additionally, individual covers 2501 may be treated with medication such as antibacterial medication, skin lotion, or odor control medication.

While the present invention has been particularly shown and described with reference to preferred embodiments thereof, it will be understood by those skilled in the art that various changes in form and details may be made therein without departing from the spirit and scope of the invention.

What is claimed is:

1. A support structure elongated in a first direction comprising:

a plurality of individual elongated inflatable pillows of substantially uniform cross-sectional shape along the length of the support structure for lying traverse to said first direction; each pillow defining an air chamber, each of said pillows having a fitting at each end thereof, the fitting at one end serving as an air inlet and the fitting at the other end serving as an air outlet;

means for supplying air to the inlet fitting of one of said pillows;

means external of said pillows for interconnecting the air chambers of the pillows in a serial serpentine sequence from the outlet of one pillow to the inlet of the next pillow to convey air from the supply means from one pillow and the other pillows of the plurality of pillows in sequence to all of the pillow chambers to cause sequential inflation of the chambers of the pillows to produce a wave-like motion of the structure as the pillow chambers sequentially inflate, said interconnection means connects said plurality of pillows in at least two separate groups of pillows with the pillows of each separate group being sequentially inflated; and means for separately and selectively inflating each of said groups of pillows.

2. The support structure of claim 1 wherein said supplying means comprises means for supplying the air and reducing the air supply in a timed sequence to control inflation and deflation of the chambers for repetitive production of the wave-like motion.

3. The support structure of claim 1 further comprising means for permitting air to exhaust from said chambers.

4. The support structure of claim 1 wherein the pillows are formed from a pair of sheets of material sealed at selected areas.

5. The support structure of claim 1 wherein each pillow is formed as a separate pillow structure.

6. The support structure of claim 5 wherein each pillow is removable from said interconnection means.

7. The support structure of claim 6 wherein each pillow is replaceable by a pillow of similar construction.

8. The support structure of claim 5 wherein each pillow is removable from said interconnection means when interconnected pillows are inflated, without causing the deflation of the interconnected pillows.

9. The support structure of claim 1 wherein each pillow is removably mounted on a support member.

10. The support structure of claim 9 wherein the each support member is hingedly connected to adjacent support members.

11. The support structure of claim 1 further includes at least one of means for heating and means for cooling supplied air.

12. The support structure of claim 1 wherein at least some of the pillows are disposable.

13. The support structure of claim 1 wherein at least some of the pillows are sterile.

14. The support structure of claim 1 wherein at least some of the pillows are treated with medicine.

15. A support structure elongated in a first direction comprising:

a plurality of individual elongated inflatable pillows along the length of the support structure which lie traverse to said first direction; each pillow defining an air chamber, each of said pillows having at least one fitting serving as an air inlet at one end, and a second fitting positioned at an opposite end serving as an air outlet, at least one of said pillows having a shape-defining member inserted in said chamber and adhered to inside surfaces of said at least one pillow for substantially maintaining a uniform cross-sectional shape along the length thereof; and means for supplying air to at least one fitting.

16. The support structure of claim 15 wherein the shape-defining member is made of an air porous material.

17. The support structure of claim 16 wherein the air porous material is foam.

18. The support structure of claim 15 wherein each of the pillows have the air inlet fitting positioned at one end, and a second fitting positioned at an opposite end serving as an air outlet.

19. The support structure of claim 18 further comprising:

means external of said pillows for interconnecting the air chambers of the pillows in a serial serpentine sequence from the outlet of one pillow to the inlet of the next pillow to convey air from the supply means from one pillow and the other pillows of the plurality of pillows in sequence to all of the pillow chambers to cause sequential inflation of the chambers of the pillows to produce a wave-like motion of the structure as the pillow chambers sequentially inflate.

20. The support structure of claim 19 wherein the interconnection means connects the plurality of pillows in at least two separate groups of pillows with the pillows of each separate group being sequentially inflated.

21. A support structure elongated in a first direction comprising:

a plurality of individual elongated inflatable pillows of substantially uniform cross-sectional shape along the length of the support structure for for lying traverse to said first direction; each pillow defining an air chamber, each of said pillows having at least one fitting serving as an air inlet positioned at one end, and a second fitting positioned at an opposite end serving as an air outlet, at least some of said pillows having an air porous support member inserted in the chamber;

means for supplying air to the inlet fitting of said pillows.

22. The support structure of claim 21 wherein said air porous material is foam.

23. The support structure of claim 21 wherein said support member comprises a means for providing support to a user regardless of whether air is supplied to said pillows.

24. A support structure elongated in a first direction comprising:

a plurality of individual elongated inflatable pillows along the length of the support structure lying traverse to said first direction, each of the pillows defining an air chamber and having an air inlet fitting positioned at one end, and a second air outlet fitting positioned at an opposite end;

means for supplying air to at least one of said air inlet fitting and said air outlet fitting; and at least one removable protective cover for individually covering at least one of said pillows.

25. The support structure of claim 24 wherein the at least one protective cover is sized to fit only one of said pillows.

26. The support structure of claim 24 wherein the at least one protective cover is disposable.

27. The support structure of claim 26 wherein the at least one protective cover is made of Tyvek.

28. The support structure of claim 24 further comprising:

means external of said pillows for interconnecting the air chambers of the pillows in a serial serpentine sequence from the outlet of one pillow to the inlet of the next pillow to convey air from the supply means from one pillow and the other pillows of the plurality of pillows in sequence to all of the pillow chambers to cause sequential inflation of the chambers of the pillows to produce a wave-like motion of the structure as the pillow chambers sequentially inflate.

29. The support structure of claim 28 wherein the interconnection means connects the plurality of pillows in at least two separate groups of pillows with the pillows of each separate group being sequentially inflated.

30. The support structure of claim 24 wherein the at least one protective cover is treated with medication.

31. The support structure of claim 24 wherein the at least one protective cover is sterilized.

* * * * *